US005301968A

United States Patent [19]

Ward et al.

[11] Patent Number: 5,301,968

[45] Date of Patent: * Apr. 12, 1994

[54] MOBILITY SUPPORT DEVICE

[75] Inventors: Adele E. Ward; J. R. Kingsley Ward, both of Richmond Hill; Kevin R. Lunau; Jeffrey D. Stringer, both of Mississauga; A. Edward Moore, Grand Pré L'Acadie; Victor J. Irving, Holland Landing, all of Canada

[73] Assignee: Guardian Products, Inc., Arleta, Calif.

[ * ] Notice: The portion of the term of this patent subsequent to Jan. 16, 2007 has been disclaimed.

[21] Appl. No.: 782,873

[22] Filed: Oct. 15, 1991

Related U.S. Application Data

[63] Continuation of Ser. No. 388,043, Jul. 31, 1989, abandoned, which is a continuation-in-part of Ser. No. 46,828, May 6, 1987, Pat. No. 4,893,826.

[30] Foreign Application Priority Data

Jul. 18, 1989 [CA] Canada ..... 514111

[51] Int. Cl.[5] ..... A61H 3/04

[52] U.S. Cl. ..... 280/87.021; 280/47.4; 297/5

[58] Field of Search ..... 16/35 R; 188/29; 272/70.3, 70.4; 280/87.01, 87.021, 87.051, 647, 650, 250.1, 304.1, 47.4; 297/5

[56] References Cited

U.S. PATENT DOCUMENTS

| | | | |
|---|---|---|---|
| 483,285 | 9/1892 | Schindler | 174/27 |
| 989,966 | 4/1911 | Hayden | 297/195 |
| 1,326,921 | 1/1920 | Dzimitowicz | 297/5 |
| 1,604,001 | 10/1926 | Vetchik | 297/320 |
| 1,611,807 | 12/1926 | Bergh | 297/6 |
| 1,638,426 | 8/1927 | Wilson | 280/87.02 W |
| 1,832,770 | 11/1931 | Hallowell | 280/47.16 X |
| 2,285,699 | 6/1942 | Everest et al. | 280/47.16 |
| 2,362,466 | 11/1944 | Carter | 135/67 X |
| 2,374,182 | 4/1945 | Duke | 297/6 |
| 2,456,874 | 12/1948 | Horner et al. | 297/313 |

(List continued on next page.)

FOREIGN PATENT DOCUMENTS

| | | | |
|---|---|---|---|
| 367207 | 1/1939 | Italy | 280/87.02 W |
| 438298 | 8/1948 | Italy | 280/87.02 W |
| 592282 | 9/1947 | United Kingdom . | |
| 832913 | 4/1960 | United Kingdom . | |
| 1251779 | 10/1971 | United Kingdom . | |
| 2047528 | 12/1980 | United Kingdom . | |
| 2076666 | 12/1981 | United Kingdom . | |

*Primary Examiner*—Margaret A. Focarino
*Assistant Examiner*—Michael Mar
*Attorney, Agent, or Firm*—Willian Brinks Hofer Gilson & Lione

[57] ABSTRACT

A mobile support device for a handicapped person and rollable on a reaction surface, the mobile support device comprises first and second longitudinally extending frame sections oriented in spaced relationship. A back support portion extends transversely between and is coupled with the first and second frame sections. A seat portion extends transversely between and is secured to the first and second frame sections. A wheel assembly is mounted on the frame sections so as to engage the reaction surface. The wheel assembly includes a pair of front caster wheels, a pair of rear caster wheels and a pair of central wheels. Each of the central wheels has a fixed transverse axis of rotation and is positioned intermediate the front and rear caster wheels to inhibit transverse motion. Each of the frame section carries one of the front caster wheels, one of the central wheels and one of the rear caster wheels. Each of the wheels has a lowermost tangent lying in a common plane. The wheel assembly constitutes means to inhibit rocking of the mobile support device about the central wheels so that contact between all of the wheels with the reaction surface is maintained. The frame sections are arranged so that unrestricted access is provided for the handicapped person to the seat portion and the back support portion. The frame sections, the seat portion and the back support portion are further arranged to permit the feet of the handicapped person to reach the reaction surface to propel the mobility support device. The mobility support device further comprises a braking means for braking at least one wheel on each of the frame sections.

24 Claims, 36 Drawing Sheets

U.S. PATENT DOCUMENTS

| | | | |
|---|---|---|---|
| 2,538,324 | 1/1951 | Petrie | 280/87.02 W |
| 2,578,382 | 12/1951 | Thompson | 248/422 |
| 2,630,160 | 3/1953 | Friedman | 297/87 |
| 2,733,754 | 2/1956 | Leslie et al. | 297/6 |
| 2,765,839 | 10/1956 | Arpin | 280/87.02 W |
| 2,920,683 | 1/1960 | Moster | 297/313 |
| 2,935,331 | 5/1960 | Ledgerwood | 280/79.3 |
| 3,158,398 | 11/1964 | Stryker | 297/333 |
| 3,446,386 | 5/1969 | Wellington | 280/79.2 X |
| 3,511,533 | 5/1970 | Drabert | 297/337 |
| 3,596,991 | 8/1971 | McKee et al. | 297/326 |
| 3,618,968 | 11/1971 | Greer | 280/47.11 |
| 3,726,560 | 4/1973 | Page | 297/349 |
| 3,778,052 | 12/1973 | Andow et al. | 272/70.4 |
| 3,788,695 | 1/1974 | Salem | 297/6 |
| 3,870,333 | 3/1975 | Burdick et al. | 280/79.1 X |
| 3,883,175 | 5/1975 | Redaway | 297/416 |
| 4,342,465 | 8/1982 | Stillings | 135/67 X |
| 4,364,605 | 12/1982 | Meiller | 297/306 |
| 4,383,714 | 5/1983 | Ishida | 297/325 |
| 4,432,582 | 2/1984 | Wiesmann et al. | 297/316 |
| 4,433,869 | 2/1984 | Payne, Jr. et al. | 297/5 |
| 4,461,471 | 7/1984 | Brastow | 272/70.3 |
| 4,498,703 | 2/1985 | Schmidhuber et al. | 297/328 |
| 4,510,956 | 4/1985 | King | 272/70.3 |
| 4,513,832 | 4/1985 | Engman | 180/6.5 |
| 4,521,053 | 6/1985 | Boer | 297/312 |
| 4,538,853 | 9/1985 | Levenberg | 297/339 |

MOBILITY SUPPORT DEVICE

This application is a continuation of application Ser. No. 07/388,043,filed Jul. 31, 1989, now abandoned, which in turn was a continuation in part of application Ser. No. 07/046,828, filed May 6, 1987, now U.S. Pat. No. 4,893,826.

The present invention relates to mobility aids.

With the steadily increasing geriatric population and the subsequent number of geriatric care facilities there has been an increasing awareness of rapid emotional and physical deterioration of their residents due to, among other things, a loss of their independence. A large portion of these residents spend extended periods of time confined to their beds or chairs and thereby need constant assistance from attending nurses to satisfy their everyday needs.

This loss in independence is not only seen as a cause for discomfort to the patient and shorter life span, but also results in substantially high costs associated with the large skilled labour force needed to provide daily care.

It would therefore be desirable both to the patients and the administrators of the facilities in which they are resident, to provide as much independence as possible to the patients. A significant factor to independence is the mobility of the patient, which is conventionally provided by wheelchairs and rigid frame structures commonly known as "walkers".

Although providing a certain degree of mobility to the patients, there are several disadvantages associated with such mobility aiding devices. Conventional wheelchairs are bulky and provide a convenience only to those patients with a relatively high degree of arm strength. Those patients who have lost strength in their arms must again demand assistance from the attendants to move from one location to another.

Conventional walkers appear in two forms one of which requires the patient to displace the structure forwardly before each step is made and is satisfactory only to those patients with sufficient strength in both the legs and the arms.

Alternatively walkers are available providing bodily support to the patients. However such devices are often large and bulky and require the patient to be entrapped within the structure, resulting in a mobility aid which, although assisting the patient, is conspicuous and therefore detrimental to the patients emotional well-being.

Accordingly, it is the object of the present invention to provide a novel form of mobility aid.

Briefly stated, the invention involves a mobile support device for a handicapped person and rollable on a reaction surface, the mobile support device comprising:

first and second substantially parallel planar frame sections oriented in spaced relationship to define a region therebetween, the lower portion of said frame sections defining a base;

a back support portion spanning the region and coupled with the first and second frame portions;

a seat spanning the region with at least a front portion thereof pivotable relative to said first and second frame portions; and a wheel assembly mounted on said base so as to engage the reaction surface.

Further features, objects and advantages of the present invention will be evident from the following detailed description of preferred embodiments, given by way of example only, as seen in the appended drawings in which.

Figure 1:
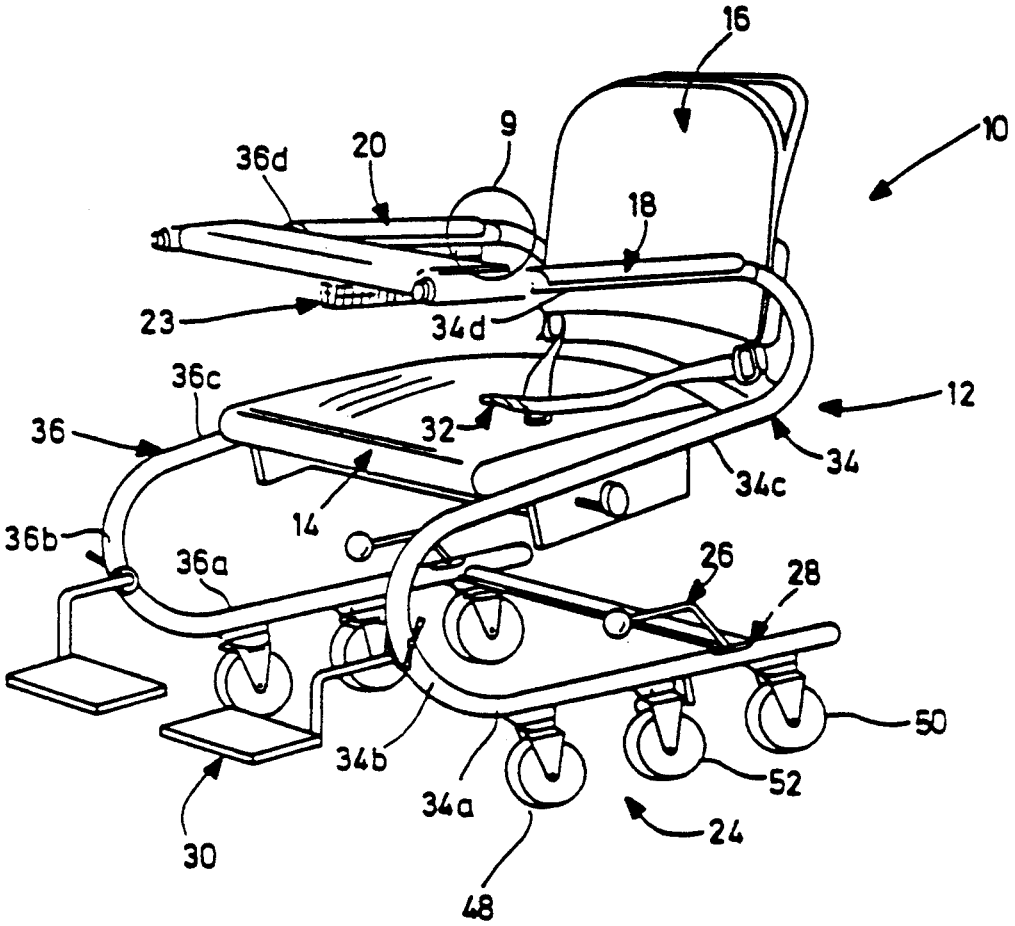
FIG. 1 is a perspective view of a mobility device.

Referring now to FIGS. 1 to 17, a mobility device 10 is shown in the form of a chair having a frame 12 which supports seat 14 and a back rest 16, with the seat being inclined at approximately six degrees from the horizontal axis and the back rest 16 inclined 15 degrees from the vertical axis. The chair has a pair of arms 18, 20 the former being pivotal and the latter being retractable as will be described. A tray 22 is mounted on the front of the arms 18, 20 and provides a working surface as well as a protective gate and hand grip. In addition a carrying hamper 23 hangs from the arm 20 for carrying magazines or other articles. A wheel assembly 24 is provided on the bottom of the chair which is controlled by a pair of braking handles 26 which activate a braking mechanism 28 as will be described. A pair of adjustable foot rests 30 are mounted on the frame 12 as will be described, with restraint being provided to the user by a seat belt 32 extending from the seat. As well, the seat is pivotable and height adjustable as will be later explained.

Figure 3:
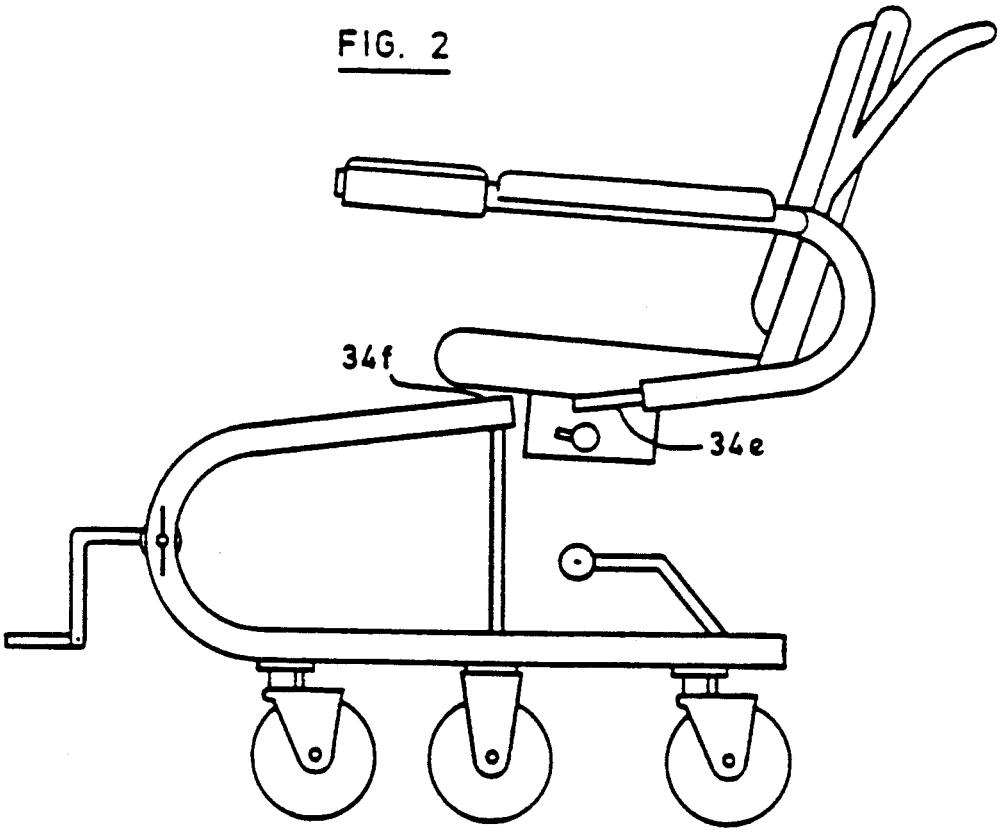
FIG. 3 is a side view of the mobility device shown in FIG. 1 in an alternate configuration.
Figure 5:
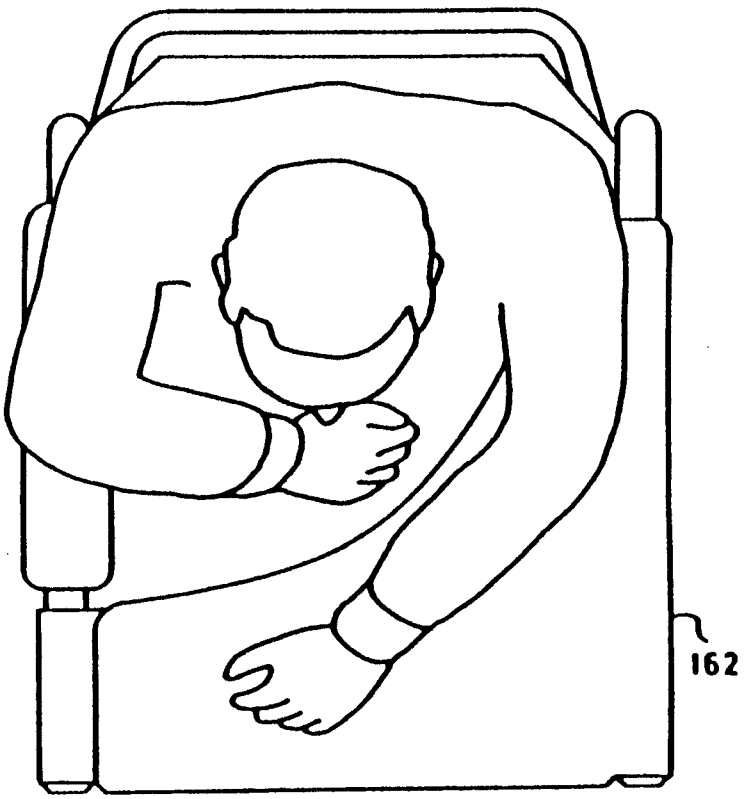
FIG. 5 is a plan view of the device shown in FIG. 1 with an alternative portion.

The frame is formed from left and right frame sections 34,, 36, both being of a "S"-shaped configuration. Each of the left and right frame sections have a lower horizontal portion 34*a*, 36*a* to support the wheel assembly a lower corner portion 34*bo* 36*b* to support the foot rests 30, a middle portion 34*c*, 36*c* to support the seat 14 and back rest 16 and an upper portion 34*di* 36*d* to support the tray 22 and also to form the arms 181 20 of the chair. As well, the middle portion 34*c*, 36*c* serves as a location for frame disassembly, as shown in FIG. 3. This is provided by way of the middle portion being formed from two parts, a first segment, for example 34*e*, having a swaged end of a second segment 34*f*.

Figure 4:
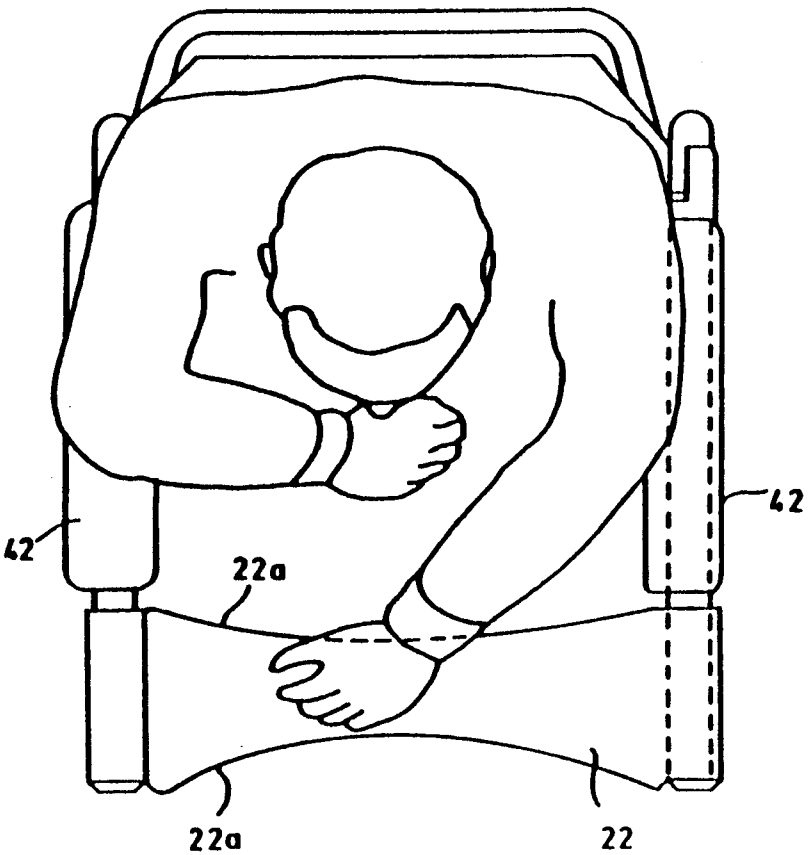
FIG. 4 is a plan view of the mobility device in FIG. 1.

Referring to FIG. 4, each of the arms 18, 20 is also provided with a pair of arm rests 42, while the tray 22 is pivotally connected to the left arm 18 and releasably positioned on the right arm 20. As well, the lateral edges 22*a* of the tray are concave thereby providing sufficient area for a working surface while enabling the patient to grip the central region of the tray 22 with his hands.

Figure 9:
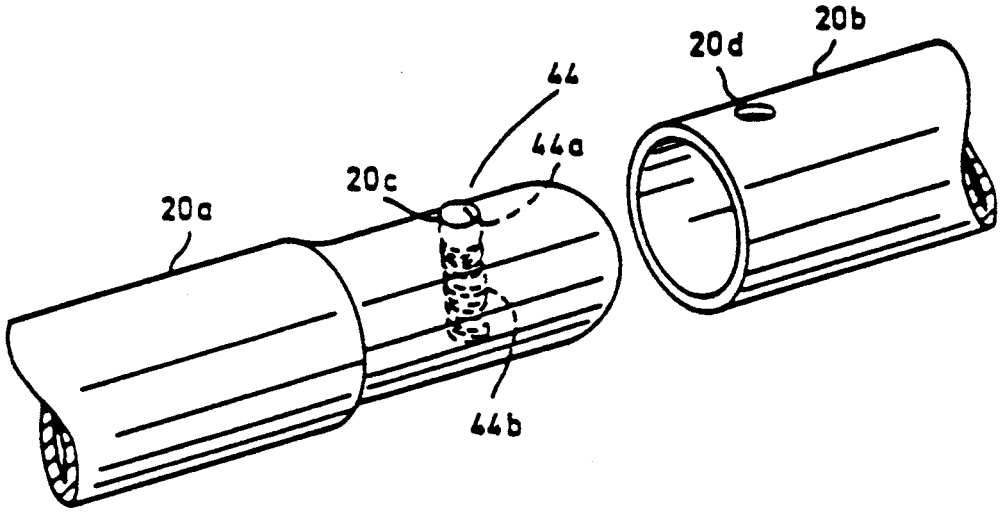
FIG. 9 is a perspective assembly view taken with respect to circle 9 in FIG. 1.

As is seen in FIG. 9. The right arm 20 is easily retractable, and is formed from first and second right arm portions 20*a*, 20*b* the first portion 20*a* having a swaged end region for telescoping engagement with the end of the second right arm portion 20*b*. A restraint mechanism 44 is provided in the first right arm portion 40*a* and is seen as a ball 44*a* nested in a hole 20*c* and biased therein by way of a compression spring, 44*b* with the ball extending from the hole so as to ex--end into a hole 20*d* formed in the second right hand portion 20*b*.

Figure 10:
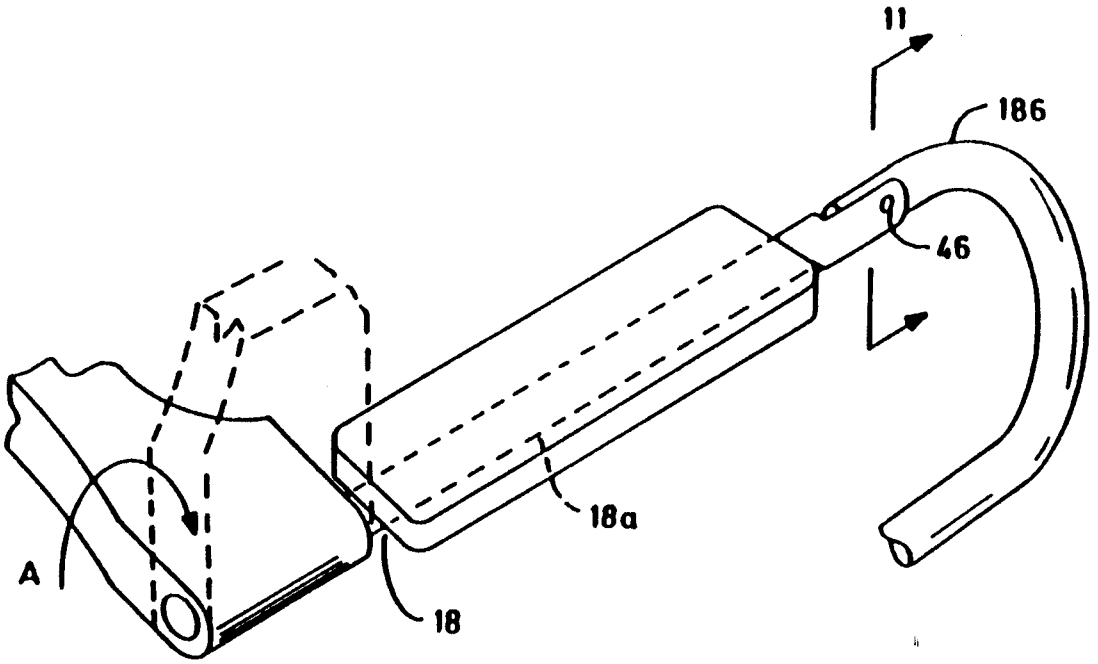
FIG. 10 is a perspective fragmentary view of another portion of the mobility device shown in FIG. 1.
Figure 11:
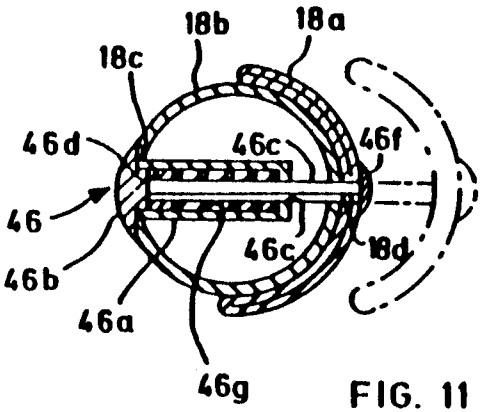
FIG. 11 is a cross-sectional view taken on line 11—11 of FIG. 10.
Figure 12:
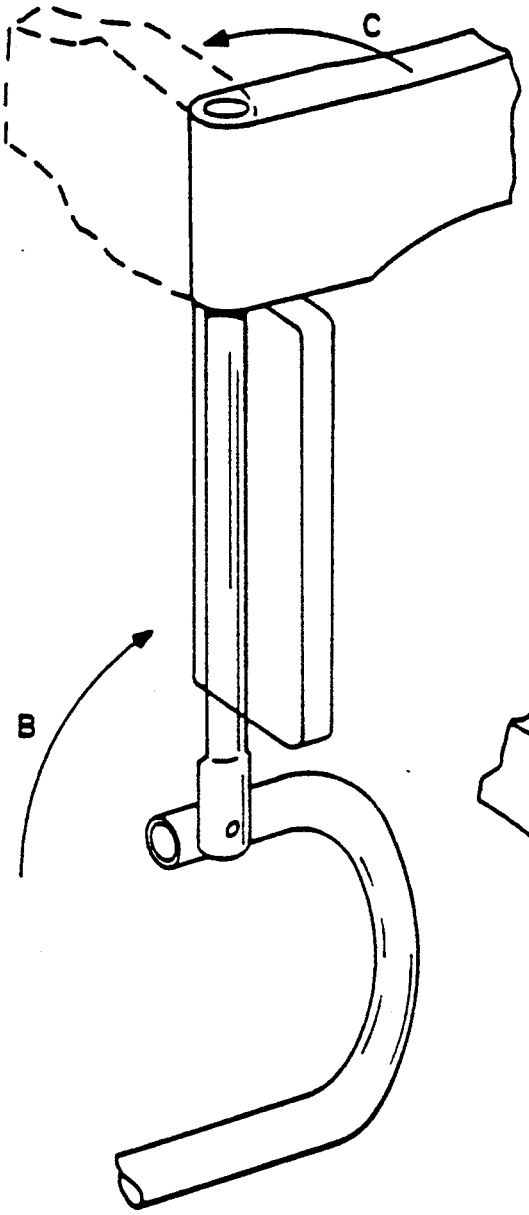
FIG. 12 is a perspective view of the portion shown in FIG. 10 in an alternative configuration.
Figure 13:
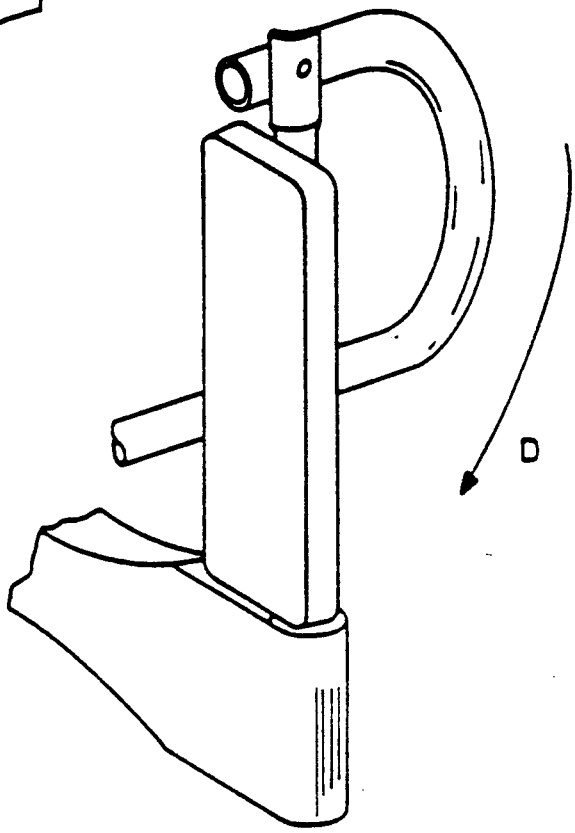
FIG. 13 is a perspective view of the portion shown in FIG. 10 in another configuration.

While the right arm 20 is retractable, the left arm 18 is pivotal between a usable position and a storage position. As seen in FIG. 10, the left arm 18 has a first left arm portion 18*a* pivotally connected to a second left arm portion 18*a* at a pivot connection identified at 45. In forming the pivot connection 45; the end of the first left arm portion 38*a* is collapsed to form a substantially "U"-shaped cross-section. As seen in FIG. 11, the first left arm portion 18*a* is pivotally connected to the second left arm portion 18*b* by way of an extensible pivot member 46 extending through coaxial bores 18*c* 18*d* formed in the first and second left arm portions 18*a* 18*b* respectively. The extensible pivot member 46 is formed from a cylinder element 46*a* closed at one end by a first head 46*b* with the other end having a bore 46*c* extending there-through. A piston 46*d* is slidably engaged with the inner surface of the cylinder element 46*a* and is joined to a shaft 46*e* which extends through the bore 46*c*, with the free end of the shaft terminating at a second head 46*f*. A compression spring 46*g* is located within the cylinder element 46*b* to bias the piston 46*d* against the first head 46*b*, such that rotation of the first left arm portion 38*a* causes separation thereof from the second left arm portion 38*b*, and causing the pivot member 46 to extend through the travel of the piston 46*d* along the cylinder element 46*a* against the spring 46*g*.

Figure 2:
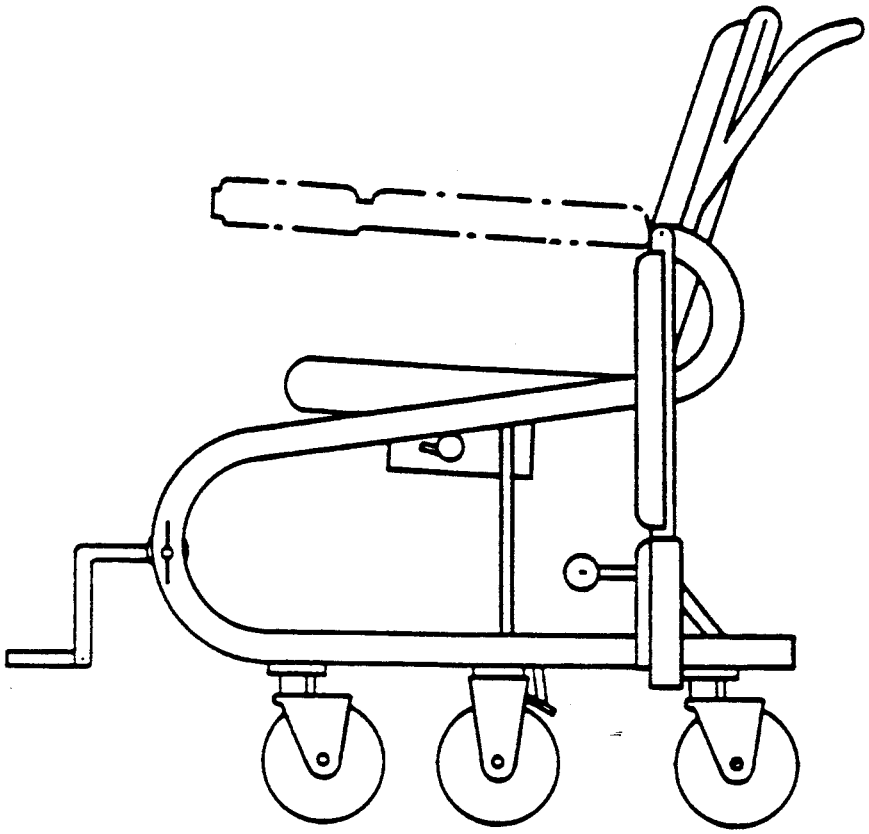
FIG. 2 is a side view of the mobility device, shown in FIG. 1, in another configuration.

The pivot connection between the first and second left arm portions 18*a*, 18*b* and pivot connection between the tray 22 and the first left arm portion 18*a* enables the left arm 18 to be rotated to a convenient storing position as demonstrated in FIGS. 2. 101 12 and 13. As is shown in FIG. 10, the tray 22 is first rotated to a vertical position as seen by the arrow "A". The first left arm portion is then rotated to an upper vertical position as seen by arrow "B". This is followed by the tray being returned to its original position relative to the first left arm portion as seen by arrow "C". Subsequently, the arm is rotated to a lower stored position as seen by the arrow "D". In his manner, the configuration embodied in the left arm 18 enables the patient to store the tray thereby providing the patient with the capability of sitting at a table, or of accessing the chair from the side.

Similarly the first right arm portion 20*a* is easily retractable by depressing the ball 44*a* through the hole 20*d* and subsequently removing the swaged end of the first right arm portion 20*a* from the second right arm portion 200.

Another particular feature of the chair 10 is the wheel assembly 24 as seen in FIG. 1 which is coupled to the lower horizontal portions 34*a*, 36*a* of the left and right frame sections 34, 36. Three wheels, for example wheels 48, 50, 52 are used on each of the lower horizontal portions, for example 34*a*, the front and rear wheels 48, 50 thereof providing a swivel movement with respect to the lower horizontal portion 34*a*. The middle wheel 52 on the other hand is constrained to rotation about an axis perpendicular to the lower horizontal portion 34*a*. In this configuration the wheels prevent lateral displacement of the chair relative to the floor while permitting increased stability and improved directional tracking, as well as the ability to rotate about a fixed point.

The braking assembly 28 is shown in detail in FIG. B. The brakes are manually controlled by braking levers 26 which extend upwardly and forwardly from slots 54 formed in the rear of the lower horizontal portions 34*a*, 34*b*. Each of the levers 26 are coupled to a first link 56 which is fixed to one end of a pivot rod 58 defining a pivot axis "E", which in turn is rotatably mounted at both ends to the horizontal portions 34*a*, 34*b*. In this fashion rotation of one first link 56 causes rotation of the other. The pivot rod 58 conveniently extends in a concealed manner within a spanner member 60 joining the left and right lower horizontal portions,34*a*,, 34*b*.

The first link 56 is pivotally connected to one end 62*a* of a second link 62 at a pivot identified at "F" which extends along the inner cavity of the lower horizontal portion 34*a*, with the opposite end 62*b* being pivotally connected to one end 64*a* of a braking link 64. The lower portion of the braking link extends downwardly to a pivot pin 66 on which the braking link pivots relative to the lower horizontal portion. The braking link extends past the pivot pin and outward from a slot 68 formed in the lower region of the horizontal portion 34*a*. Joined to the other end 64*b* of the braking link 64 is a brake pad 69 of an arcuate shape so as to contact the floor contacting surface 53*a* of the center wheel 53.

Thus, when either of the levers 26 is rearwardly displaced, the first link 56 rotates about the pivot rod 58 causing the second link 62 to be displaced forwardly. This in turn causes rotation of the braking link 64 about the pivot pin 66 to engage the brake pad 69 with the floor contacting surface 53*a* of the wheel 53.

In this manner, the braking assembly 28 provides simultaneous braking of both left and right centre wheels 53 by rotation of either braking lever 26. In addition, the pivot points are selected in the first link such that the pivot point "F" of the second link is "over-center" with respect to the pivot axis "E" of the pivot rod 58. In this manner, the braking assembly 28 provides a self-locking mechanism whereby the braking lever 26 is rotated toward contact with the rear edge of the slot 54. This corresponds to a point where the pivot point "F" is located above axis "E" thereby causing the reaction force, exerted by the wheel 54 and transmitted through the mechanism 28, to maintain the lever 26 in the locked position against the rear edge of the slot.

In an alternative embodiment, the braking mechanism 28 is capable of providing a constant light braking force to the middle wheels for a controlled substantially unaccelerated travel down an incline. This is provided by an arcuate bracket 70 which is fixed to the lower horizontal portion 34*a* of the frame adjacent to the central region of a brake lever 26. The bracket 70 has a number of notches 70*a* formed therein to enable the lever 26 to be locked in a particular orientation so as to provide a constant braking force against the wheel 53. In this case, the extent of rotation of the lever 26 to maintain substantially unaccelerated travel, increases with the degree of incline being traversed. If desired, the pivot rod 66 may be located on the frame 53*b* of the wheel rather than on the -lower horizontal portion 34*a*, thereby providing relatively shorter distance of travel of the brake pad 69.

Figure 6:
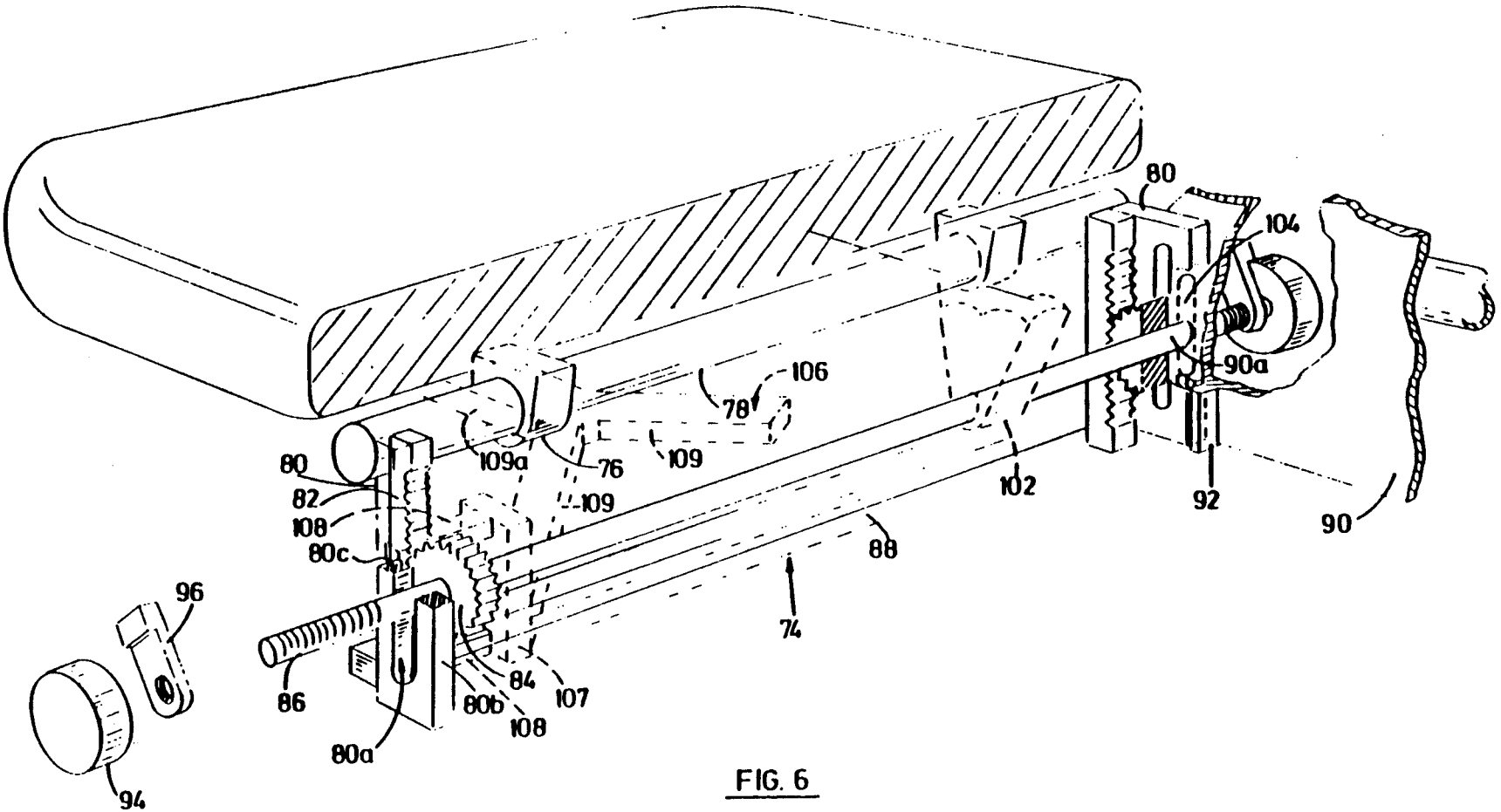
FIG. 6 is a partly exploded view of a portion of the mobility device shown in FIG. 1.
Figure 7:
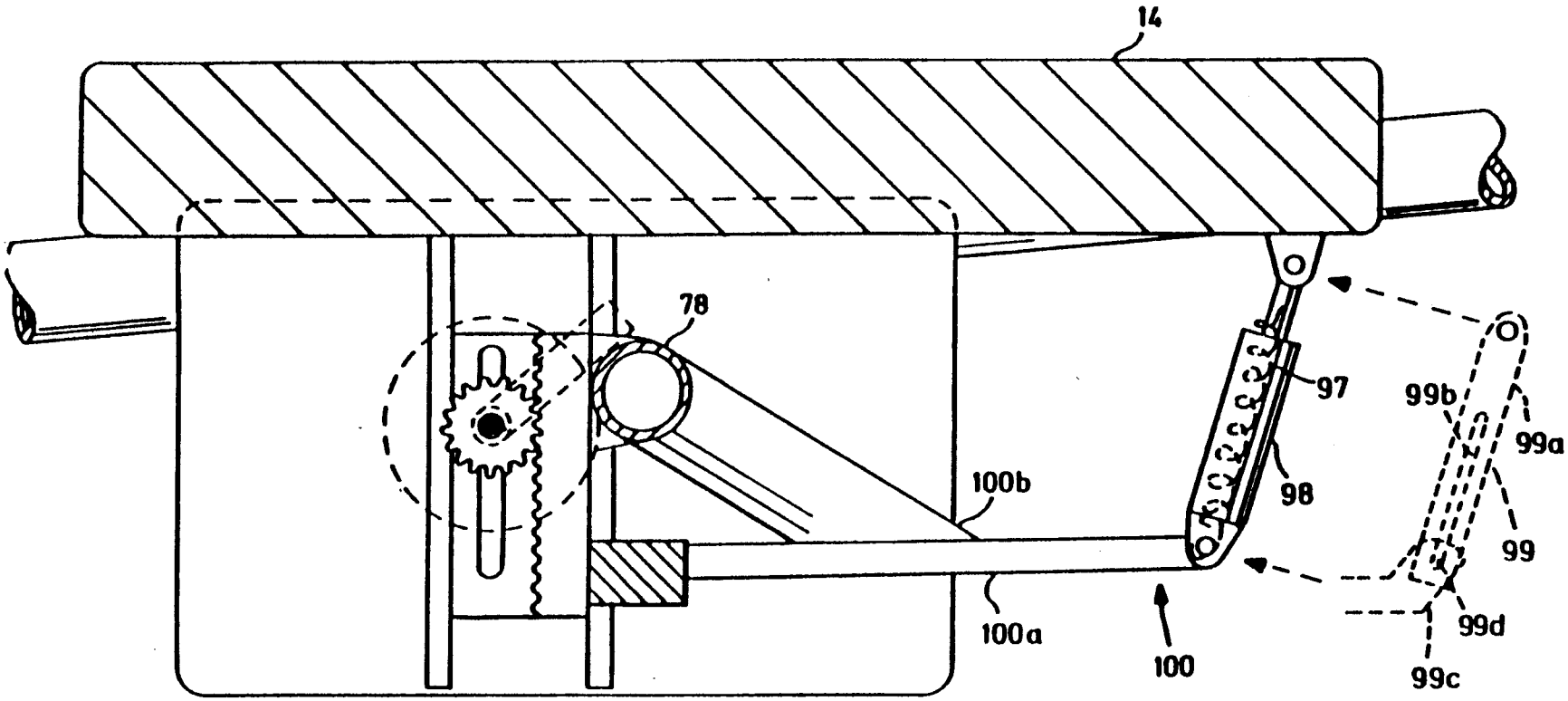
FIG. 7 is a cross-sectional view taken on line 7—7 in FIG. 6.
Figure 8:
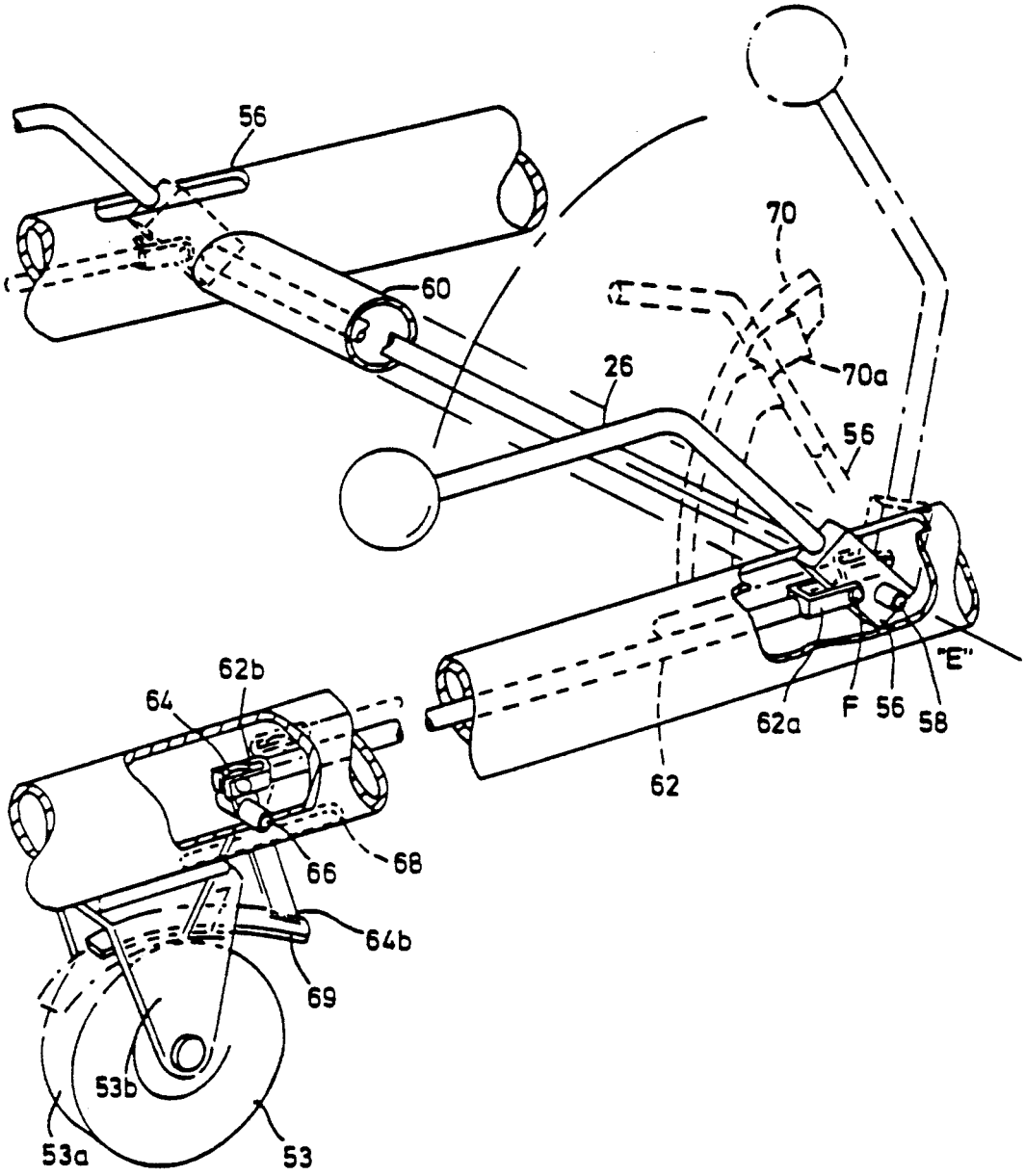
FIG. 8 is a fragmentary perspective view of a portion of the mobility device shown in FIG. 1.

The chair is also provided with a seat 14 which is pivotal and height adjustable by way of a height adjustment mechanism 74 illustrated in FIGS. 6 and 7. The seat is pivotally mounted via a pair of first support blocks 76 to a tubular shaft 78, the shaft being held at each end by a second support element 80. Adjacent the second support element 80 is a rack element 82 of a rack and pinion arrangement, the pinion 84 being fixed to a rod 86 which extends through a slot 80*a* formed in the second support element 80. Both the second support element 80 and the rack element 82 are fixed to a transverse frame element 88.

Positioned adjacent the second support element is a plate element 90 having a centrally located bore 90*a*, through which the rod 86 extends. In addition, a pair of guides 92 extend downwardly along the inner surface of the plate so as to engage with the front and rear edges 80*bi* 80*c* of the second support element 80. Fixed to the end of the rod 86 is a knob 94 for rotation of the rod 86 and accordingly the pinion 84 along the rack element 82. The region of the rod 86 between the knob 94.and the plate 90 is threaded to engage threadably with a release latch 96, which releasably maintains the rod 86 in position.

The height adjustment mechanism provides facilitated adjustment of the seat 14 relative to the frame 12, by way of rotating the release latch 96 and subsequently turning the knob 94. This causes relative displacement between the rack element 82 and the pinion 84, and results in the support element 80 travelling along the guide 92.

A further mechanism is provided on the seat to dampen sudden rotations of the seat relative to the shaft. In FIG. 7 an air cylinder 98 is joined to the central region of the rear of the seat 14 and to a support frame 100 which includes an arm 100*a* extending rearwardly from the transverse frame member 88 and a brace 100*b* joining the arm 100*a* with the shaft 78.

In this manner, the dampening of rotation of the seat 14 is provided at any elevation thereof. With this assembly forward movement of the patient from the back of the seat causes an immediate rotation of the seat 14 about the shaft 78, with the rotation being maintained at a slow rate by the air cylinder 98. If the patient further wishes to propel the chair along the floor, he may do so by continuing to rotate the seat 14 until his feet are in contact with the floor.

Another embodiment is shown in dashed lines in FIG. 6 wherein the seat is pivotally mounted on shaft 86 by way of support blocks 102 in lieu of support blocks 76 and shaft 28. In addition, the rack element 82 and the support block 80 are fixedly mounted to plate element 90 while shaft 86 is displaced relative to plate 90 by extending through a slot 104, thereby eliminating the need for guides 92 and transverse frame element 88. As well, a support frame 106 is pivotally mounted on shaft 86 in lieu of support frame 100. In this case, support frame 106 includes a support block 107 pivotally mounted on the shaft 86 adjacent each pinion element 84. Projections 108 extend from the upper and lower portions of support block 107, adjacent to but not contacting the teeth of pinion 84, and extend through the slots 80*a*. In this manner, support block 107 displaces in concert with the rod 86 but does not rotate therewith. Extending rearwardly from each of the support blocks 107 is a frame member 109 which terminating at a junction with a frame member 109*a* which extends toward connection with the air cylinder 98.

In yet another embodiment, a tension spring 97 is located adjacent the air cylinder 98 to bias the seat to its rearwardly inclined position.

In a further embodiment, a rotation limit device 99 is located adjacent the air cylinder 98 to restrict the rearward and forward rotation of the seat to the desired six degrees with respect to the horizontal. The limit device includes an elongate element 99*a* having a slot 99*b* which is connected to the rear portion of the seat. A member 99*c* with a pin 99*d* is coupled to the arm 100*a*.

Figure 14:
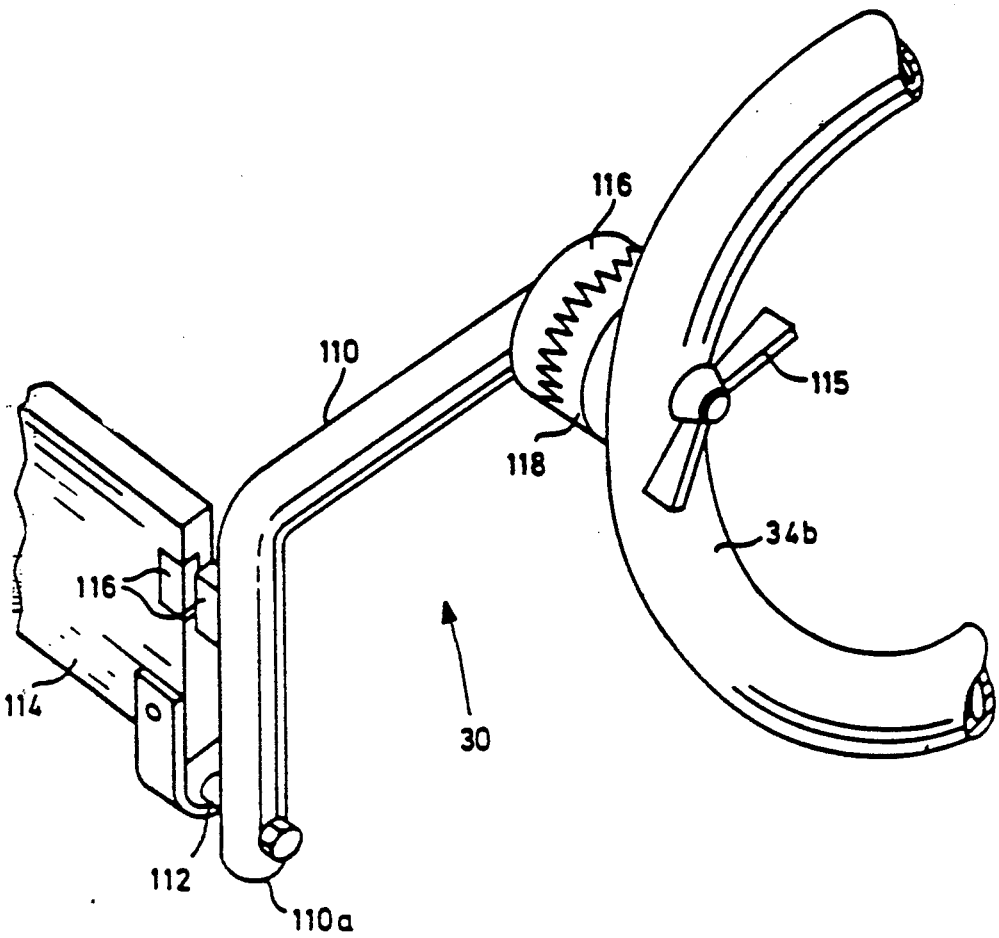
FIG. 14 is a perspective view of another portion of the mobility device shown in FIG. 1.
Figure 15:
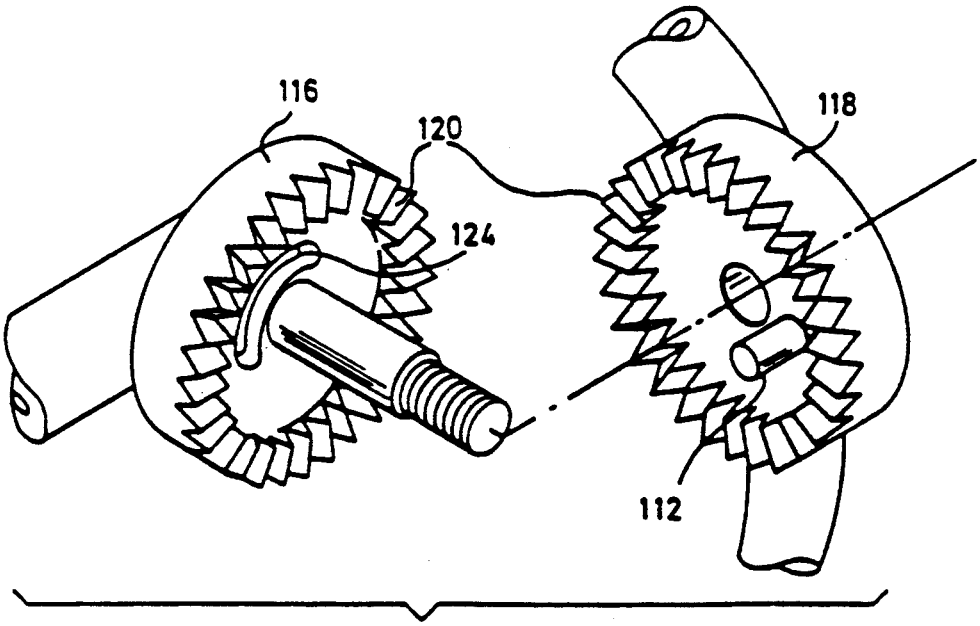
FIG. 15 is a perspective assembly view of a portion of an element shown in FIG. 14.
Figure 16:
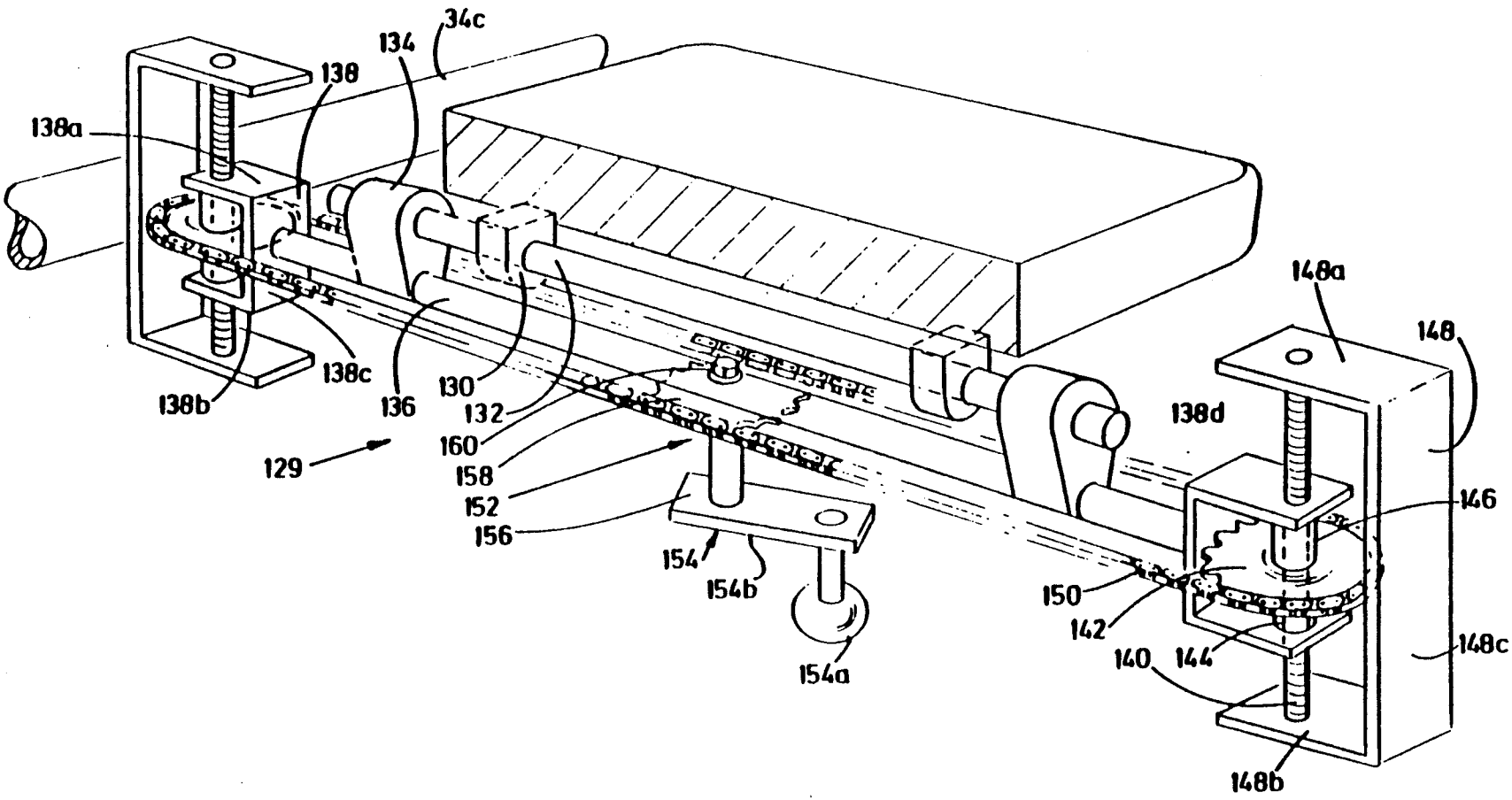
FIG. 16 is a partly exploded assembly view of an alternate configuration of the portion shown in FIG. 6.
Figure 17:
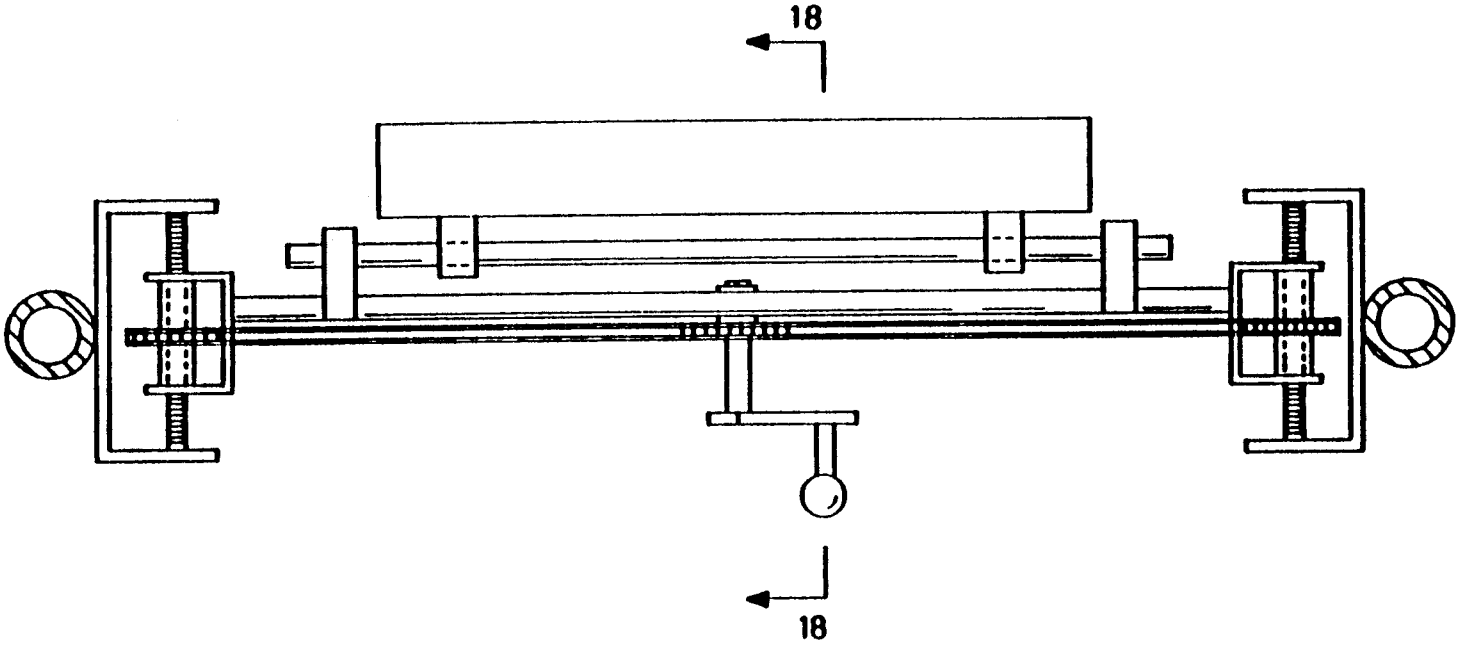
FIG. 17 is a frontal view of the configuration in FIG. 16.

The chair is also provided with adjustable foot rest 30 as are shown in detail in FIGS. 14 and 15. The foot rest 30 includes an angular member 110 having a shaft 112 connected to one end 110*a*. A foot pad 114 is pivotally connected to the shaft 112 for movement between a horizontal position and a vertical position. Magnets 116 are further provided both on the foot pad 114 and the angular member 110 to maintain the foot pad 114 in a vertical position. The angular member is in turn joined to the lower corner portion 34*b* by a wing nut 115, and maintained in a given orientation by a pair of interconnecting discs 116*i* 118.

As seen in FIG. 15, each of the discs have transversely extending triangular teeth 120 which mesh upon engagement of the discs 116 118, with the disc 116 being fixed to the angular member and the other disc 118 being fixed to the lower corner portion 34*b*. The discs 118, 116 are also respectively provided with a pin 122 and recess 124 as shown in FIG. 15 to enable interengagement of the discs within predetermined limits, thereby preventing the foot rest 30 from contacting the floor, thereby interfering with the mobility of the chair.

Figure 21:
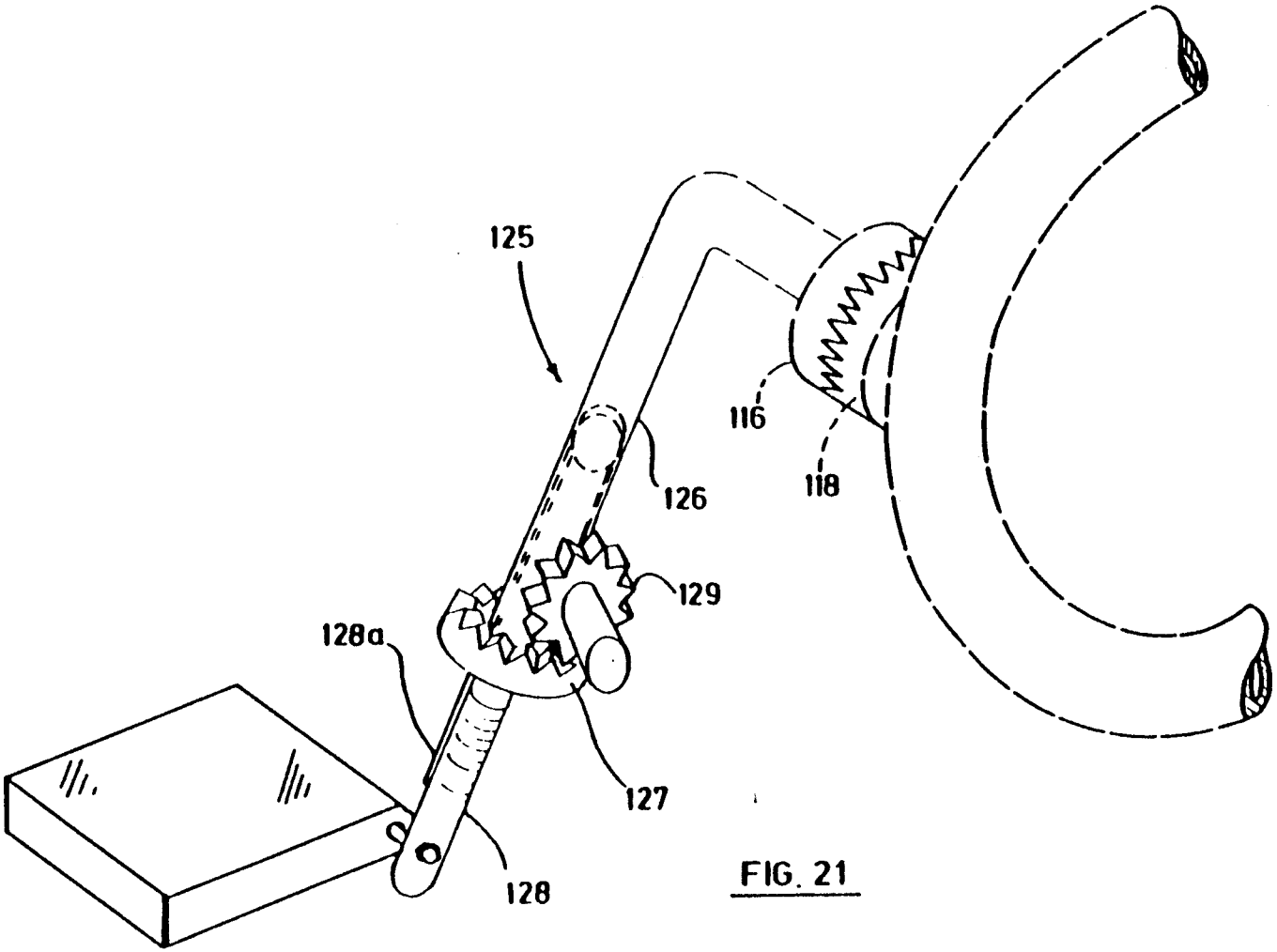
FIG. 21 is a perspective view of another alternate portion of the device shown in FIG. 1.

An alternative foot rest 125 is shown in FIG. 21 wherein a right angled member 126 extends from the inter-engaged discs 116, 119 and terminates at a crown gear element 127 rotatably mounted circumferentially thereon. The crown gear is threadably engaged with a threaded rod element 128 which includes an elongate rectangular projection 128*a* extending along the shaft to engage with a complimentary recess on the inner edge of the member 126. The foot rest 125 is further provided with a pinion element 129 rotatably mounted to the right angled member 126, teeth 126*a* of which are meshed with the teeth 127*a* of crown gear 127. A knob 129*a* is also fixed to the pinion element 129 so as to enable the user to cause rotation thereof, which in turn causes the crown gear 127 to rotate and the threaded rod 128 to be displaced relative to the member 126. In this manner, the length of the foot rest 125 is easily adjustable to accommodate users with different leg lengths.

An alternative to the aforementioned height adjustment mechanism 74 of the seat is the height adjustment mechanism 129 shown in FIGS. 16 to 19. In this case the seat is pivotally mounted by a pair of first support blocks 130 to a tubular shaft 132, the shaft being held at each end by a second support block 134. The second support block 34 is in turn mounted to a first transverse frame member 136. Each end of the transverse frame member 136 is fixed to a slider frame 381 defined by a pair of spaced horizontal flanges 138*al* 138*b* and joined by a vertical web 138*c*. The flanges have centrally located and coaxial bores 138*d* which receive a threaded shaft 140. Threaded on the shaft 140 is a remote sprocket 142 positioned at spaced distances from each of the flanges by upper and lower spacers 144, 146. The threaded rod is in turn held in a support frame 148, again defined by a pair of horizontal flanges 148*a*, 148*b* and joined by a vertical web 148*c*. In this case,, each of the support frames 148 is fixed to the central region of the middle portion 34*c* of the frame sections.

A chain 150 passes over each of the remote sprockets to a central crank mechanism 152 located in the central region of the transverse frame member. The crank mechanism comprises a crank 154 member having an offset cranking knob 154*a* mounted on a cranking arm 154*b*. The cranking arm is in turn mounted on a shaft 156 to which a sprocket 158 is also mounted. The shaft 156 is rotatably mounted in the transverse frame member by way of releasable mounting through a bore 136*a* and maintained therein by a nut and washer 160. In this manner, rotation of the crank arm 154*b* via the knob 154*a* causes the chain 150 to be displaced in a manner which causes rotation of the remote sprockets 142. By virtue of their threaded engagement with the threaded rods 140, the sprockets 142 then upwardly displace with respect to the threaded rods 140, thereby raising the elevation of the seat.

Figure 19:
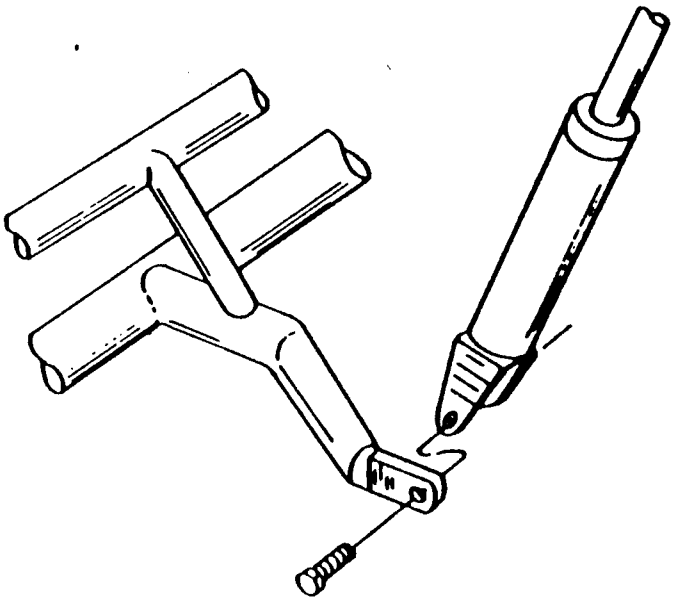
FIG. 19 is an exploded assembly view of several components of the portion shown in FIG. 18.
Figure 18:
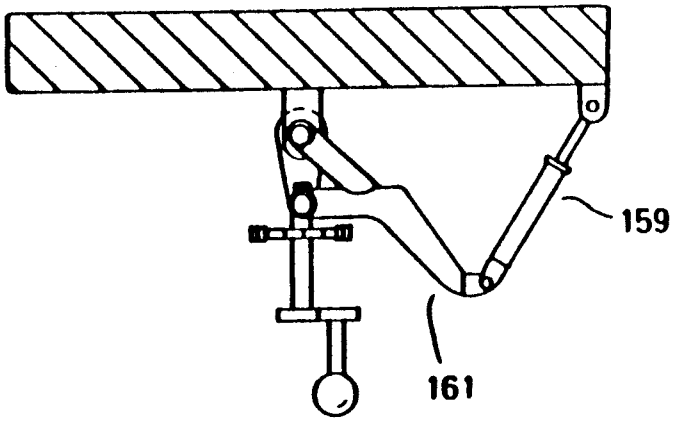
FIG. 18 is a cross-sectional view taken on line 18—18 in FIG. 17.

Incorporated with the height adjustment mechanism 129 is an air cylinder 159 mounted at one end on the rear portion of the seat as is shown in FIGS. 18 and 19. The air cylinder is mounted at its other end to a frame assembly 161 extending rearwardly from the shaft 132 and the transverse frame member 136. It should also be noted that the air cylinders 98 and 159 each provide a dampening effect to both forward and rearward locations of the seat. This dampening effect could also be provided in one rotative sense only or be greater in one rotative sense than in the other. Oil cylinders are also contemplated as an alternative to the air cylinders.

Also contemplated is a height adjustment mechanism utilizing a rack and pinion arrangement, wherein the rack element thereof is fixed relative to the seat frame, while the axis of pinion element is fixed on a pivot shaft displaced relative to the seat frame. In addition, the seat may be pivotally mounted on the pivot shaft.

In addition, an alternative to the aforementioned concave edged tray 22 is shown in FIG. 4 wherein the tray 162 is incorporated with one arm pad,, to provide an increased arm support particularly for patients having suffered from a stroke or from other causes, resulting in little strength in one arm. Also contemplated is the use of a restraint bar in place of the tray.

Figure 20:
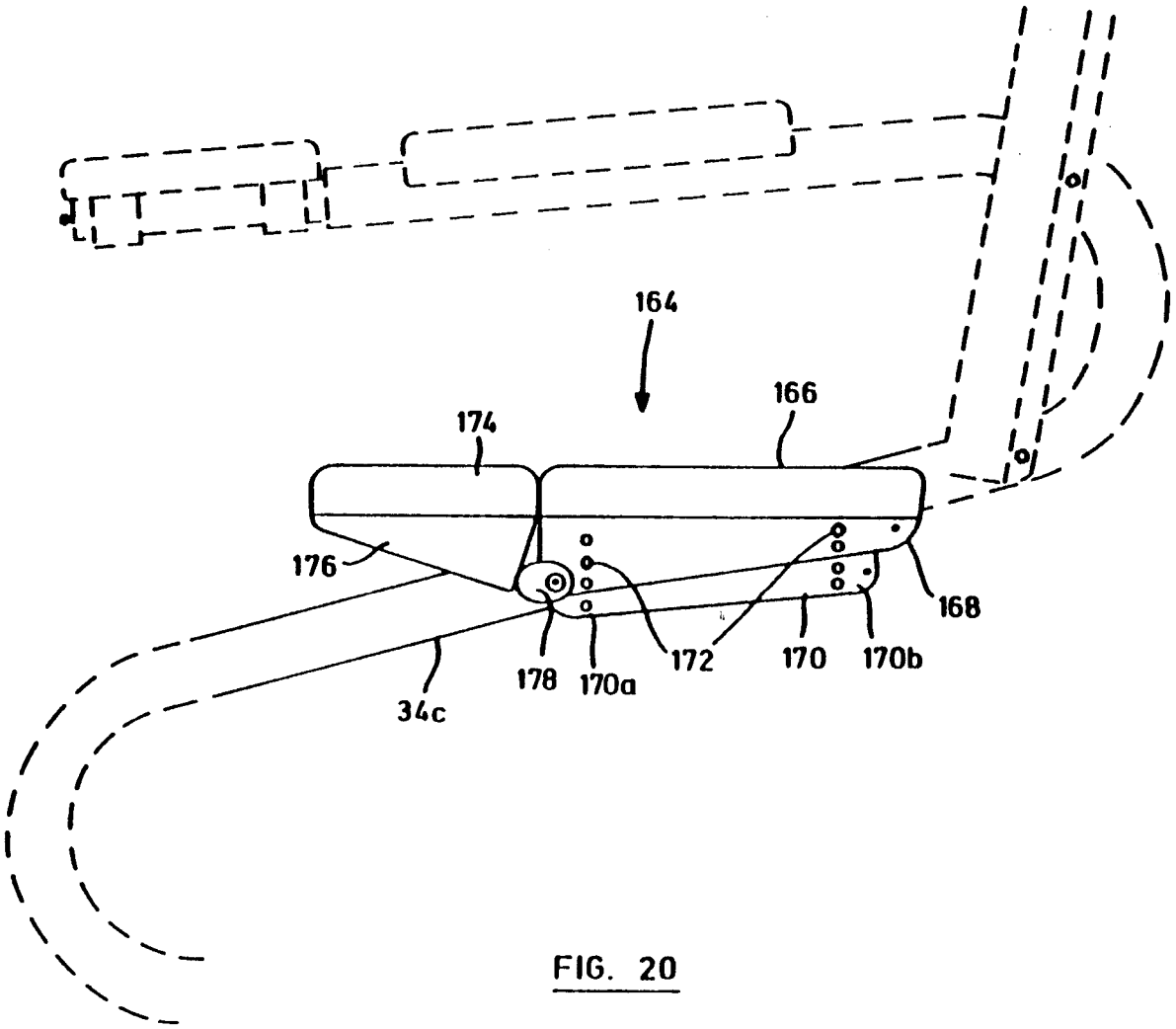
FIG. 20 is a side view of an alternative portion of the device shown in FIG. 1.

Also contemplated for adjusting the height of the seat is the use of a split seat 164 as shown in FIG. 20. The split seat 164 includes a rear section 168 which is mounted to the middle portion 34*c* of the frame by way of a pair of flanges 168 depending from each side of the rear section 166, which slidably engage with a frame plate 170 mounted on the middle portion 34*c*. A series of holes 170*a*, 170*b* are located near the front and rear ends respectively of the frame plate 170 and are in-line with holes 168*a*, 168*b* located in the front and rear ends respectively of the flange 168 so as to receive adjustment pins 172. A front section 174 is hingeably mounted to the rear section 166 and has on each side a downward projection 176 which abuts a cam element 178.

Figure 22:
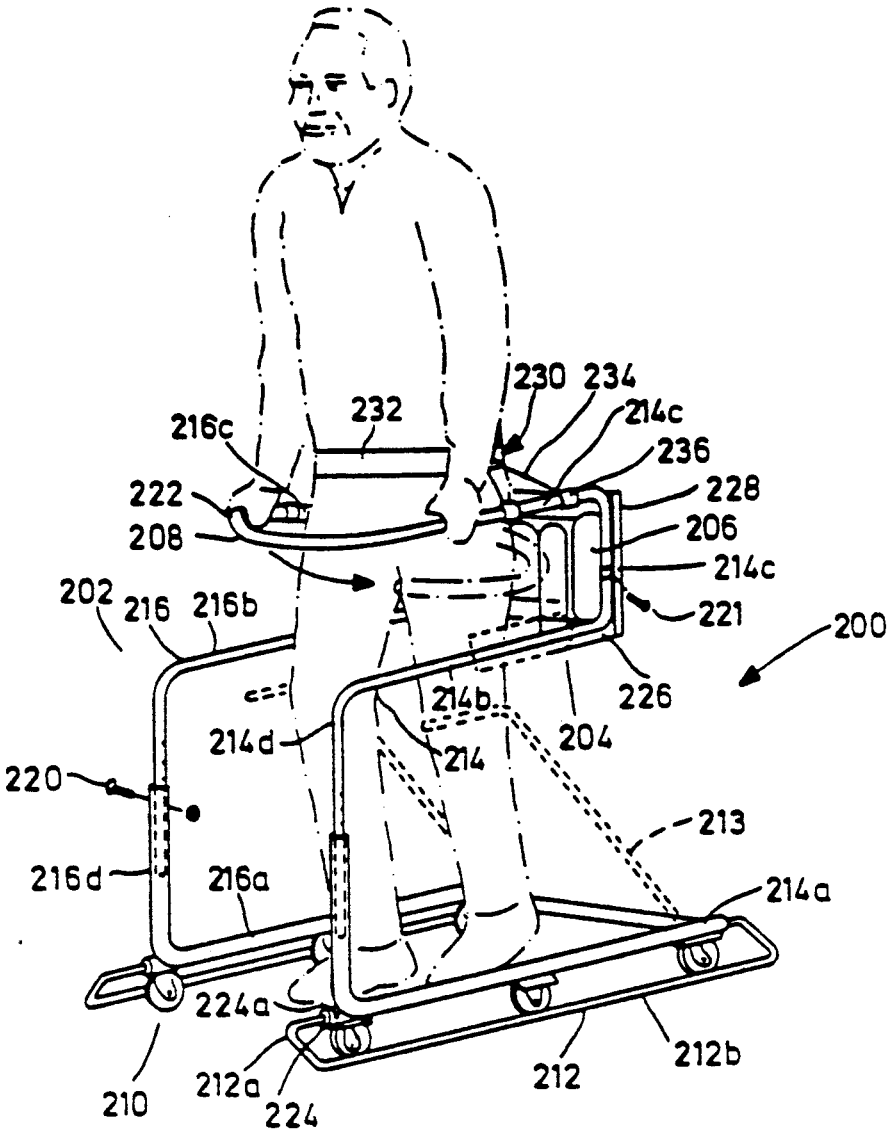
FIG. 22 is a perspective view of an alternative mobility device.

A second embodiment of the mobility device is shown in the form of a stand-up walker 200 in FIG. 22. The walker includes a frame 202 which supports a seat 204 pivotal between horizontal and vertical positions and a back rest 206. The support includes a releasable restraint bar 208 which assists in supporting the user as will be described. A wheel assembly similar to that in the aforementioned embodiment, and identified at 210 is located in the lower end of the frame for mobility while a pair of outriggers 212 extend transversely from the frame and adjacent to the wheels as will be described.

In addition the stand up walker 200 may also include a braking mechanism in accordance with braking mechanism 28 in the aforementioned embodiment and, in which case, is equipped with length adjustable arms 213.

The frame structure is formed from left and right frame sections 214, 216, each of an "S"-shaped configuration, to form lower, middle and upper horizontal frame segments 214*a*, 214*b*, 214*c* and 216*a*, 216*b*, 216*c* respectively. The lower frame segments combine with a spanning member 218 which extends between the rear region of the lower segments 214*a*, 216*a* to form a base, while the upper segments 214*cl* 216*c* combine to form the left and right arms of the walker 200. Joining each of the lower and middle segments is a first vertical spanner 214*c*, 216*d* formed from a pair of telescoping elements which, joined by a bolt configuration identified at 220, so as to provide a walker 200 which may be disassembled.

Disassembly is also provided by a second vertical spanner 214*ep* 216*e* formed from a pair of telescoping elements which, joined by a bolt configuration shown at 221 may be either disassembled or length adjusted.

The restraint bar 208 is pivotally connected to the left arm 214*c*, while the opposite end of the restraint bar is coupled to the right arm 216*cl* by way of a releasable latch 222.

Projecting longitudinally from each end of the lower frame segments are collars 224 which engage with the right angled ends 212*a* of rectangular outriggers 212. Joining the right angled ends thereof is a body member 212*b*. The collars 224 are further provided with a bore 224*a* which receives a pin to fix the outrigger 212 with the lower surface of the body member having an incremental spacing from the floor surface, for example one half inch. In this manner, the outrigger 212 provides a support against inadvertent tipping of the walker 200. As seen in FIG. 22, the seat 204 is pivotally connected to a pair of brackets 226 immediately below the back rest 206 which in turn is mounted on a fixed cross panel 228.

The seat 204 provides a support for the patient in a partial sitting position in which, while gripping the arms 214*c*, 216 or the restraint bar 208 may propel the walker 200. As seen in FIG. 22, the seat 204 is pivotally connected to a pair of brackets 226 immediately below the back rest 206, which in turn is mounted on a fixed cross panel 228.

The seat 204 provides a support for the patient in a partial sitting position in which, while gripping the arms 214*c*, 216 or the restraint bar 208 may propel the walker 200. Alternatively, the seat may be stored in a vertical position enabling the patient to walk with the support of the walker in a standing position, with further support.being provided by a harness 230.

The harness 230 includes a belt 232 which extends around the central region of the user, and has a releasable buckle in the rear portion thereof. The belt 232 is joined to the arms 214*c*, 216*c* by way of four expandable belts 234, which are coupled to the arms 214*c* 216*c* by way of releasable brackets 236.

Figure 23:
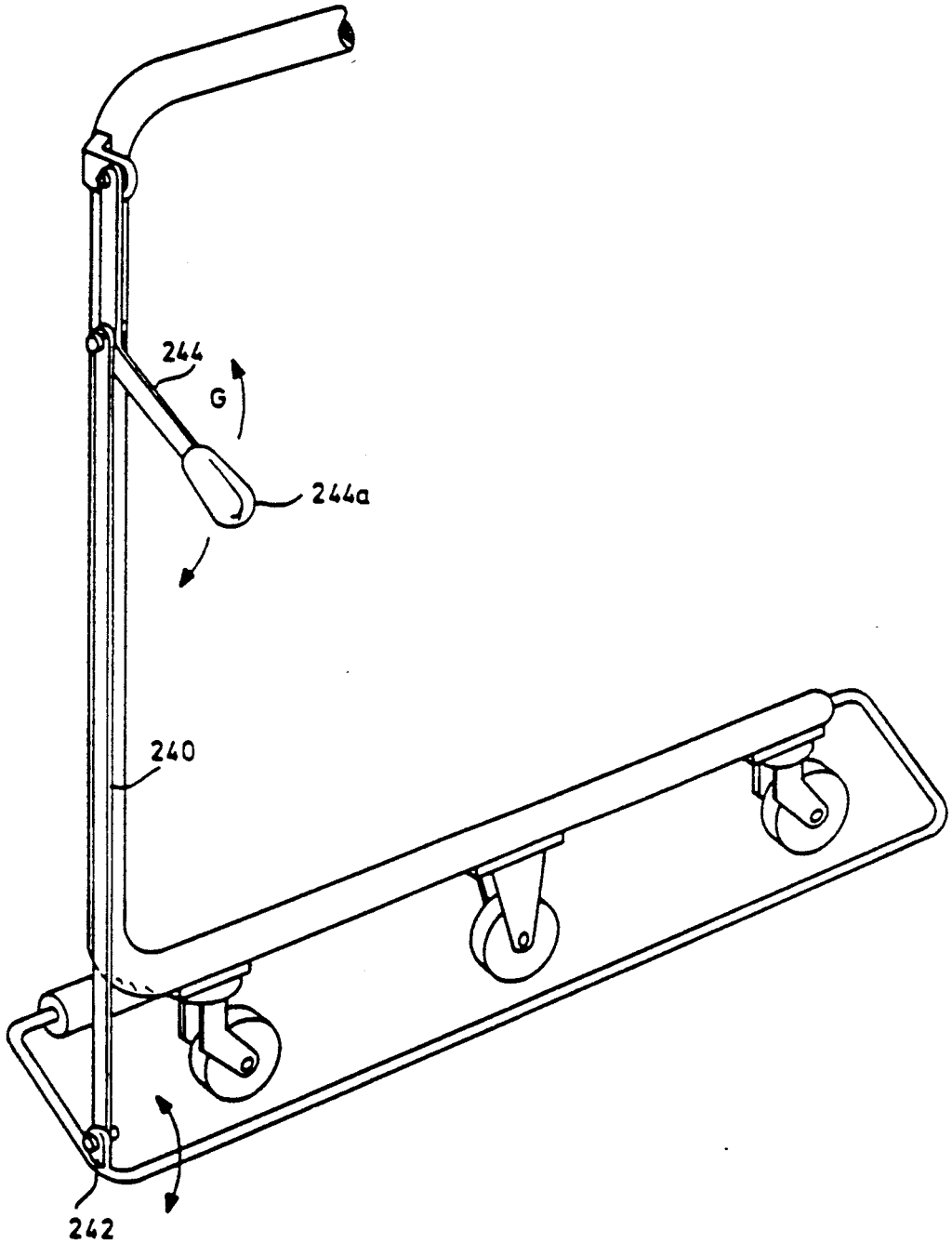
FIG. 23 is a perspective view of a portion of an alternative mobility device to the device shown in FIG. 22.

An alternative to the fixed outrigger is shown in FIG. 23 wherein the pins are omitted from the collars so as to enable the outrigger 212 to rotate therein. In addition, a first link 240 is pivotally connected between a remote point on the front right angled member shown at 242 and a pivot point in the central region of a second link 244. The second link in turn is pivotally coupled to the vertical spanner 214*d* and has at its remote end, a handle 244*a* enabling the patient to rotate the second link upwardly in the direction of the arrow identified at "G". In this manner the outrigger is easily retracted to a stored position, enabling the walker to pass through a doorway.

Figure 25:
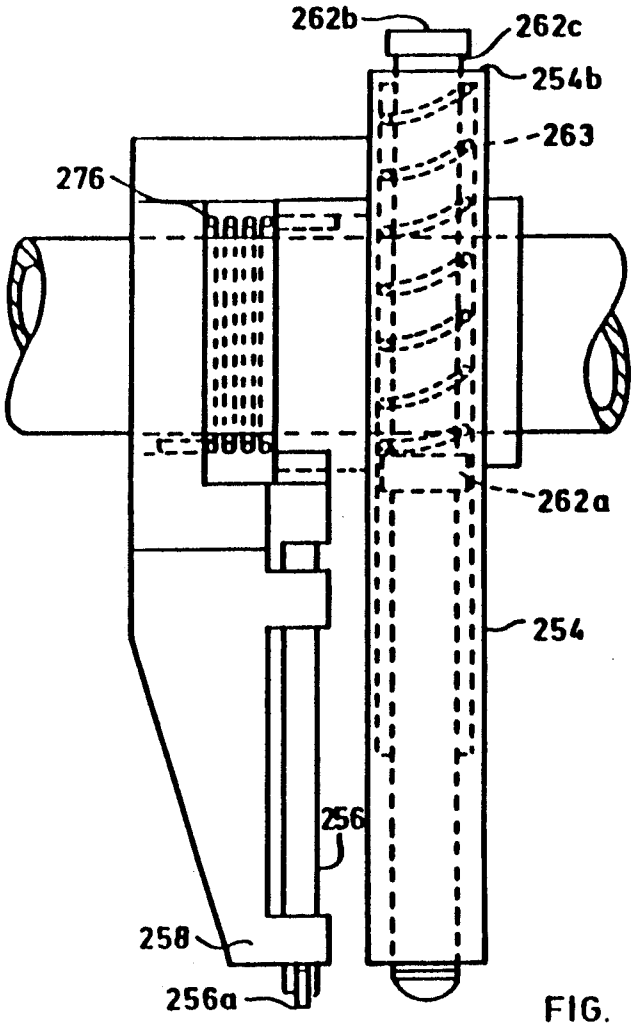
FIG. 25 is a side view of the element shown in FIG. 24.
Figure 24:
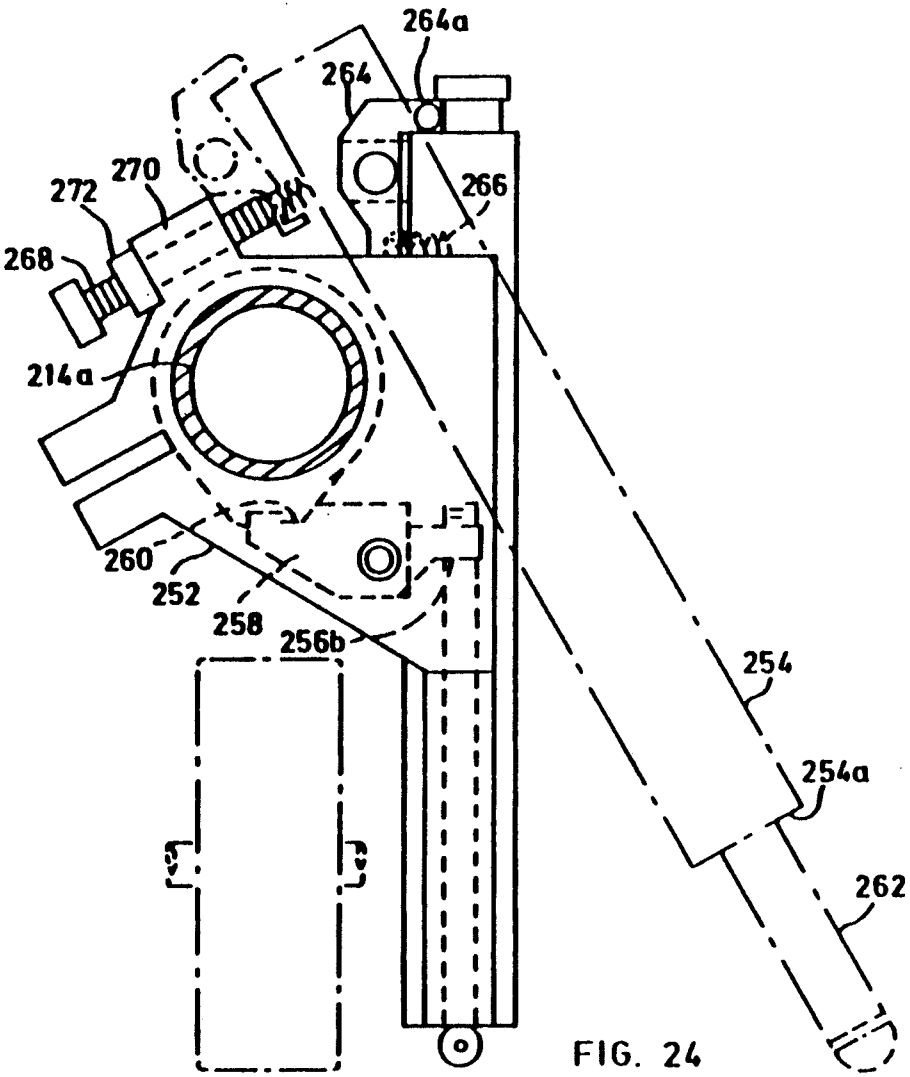
FIG. 24 is a frontal view of an alternative element of the portion shown in FIG. 23.

A further alternative to the fixed outrigger is an automatically extendable outrigger 250 as shown in FIGS. 24 and 25. The automatic outrigger 250 is formed front a first housing 252 and a second housing 254, the second housing 254 being pivotal relative to the first housing 252, which is secured to the lower frame segment 214*a*. Located on the first housing 252 is an activation rod 256 which is oriented at one end 256*a* in close proximity with the floor surface, and is slidably engaged within brackets 258' extending near each end thereof from the first housing 252. The other end 256*b* of the activation rod 256 is engaged with a first latch 258 which is pivotally mounted to the first housing 252 and engages a catch 260 formed on the second housing. The second housing 254 is tubular and has one end 254*a* through which outwardly extends a deploy rod 262 which is slidably engaged with the inner surface of the second housing. The deploy rod is also biased to an outwardly extended position by way of a spring 263, also within the second housing and engaged with a boss 262*a* formed in the central region of the deploy rod 262. The other end 254*b* of the second housing has an aperture formed therein, through which the other end of the deploy rod 262*b* outwardly extends in a stored position as shown in FIG. 21. The end of the deploy rod is defined by a circumferential groove 262*c* which engages with the finger 264*a* of a second latch 264, pivotally mounted to the second housing 254 and biased against the groove by a spring 266.

The second latch 264 is activated by way of an abutment rod 268 which is positioned in a bracket 270 formed on the first housing 252 and adjusted to the required extension therefrom by way of a set screw 272, so as to engage the other end of the second latch 264 upon rotation of the second housing 254 with respect to the first housing 252 under the biasing force of a coil spring 276 joined therebetween.

In this manner inadvertent rotation of the frame 12 relative to the floor causes the floor to engage with the activating rod 2561 resulting in the release of the first latch 258. This causes the second housing 254 to quickly rotate under the force of the coil spring 276 to a lateral outward position, causing the second latch 264 to engage with the abutment rod 268 thereby releasing the deploy rod 262 from within the second housing 254. In this manner the deploy rod 262 acts as an additional stabilizer to increase the lateral stability and prevent further rotation of the frame 12 relative to the floor. In addition, the angle through which the second housing 254 rotates and the relative length of the second housing 254 and the deploy rod 262, are chosen such that in the extended position, the frictional force between the inner wall of the second housing 254 and the second deploy rod 262 provides a binding reaction force, thereby enabling the housing and the deploy rod to function as a unitary support member against the force exerted by the patient against the frame 12 of the walker.

When the frame is returned to its stable position, the binding force between the deploy rod 262 and the inner surface of the second housing 254 is immediately reduced to enable an attendant to easily retract the outrigger 250 to its stored position as shown in FIG. 22.

Figure 26:
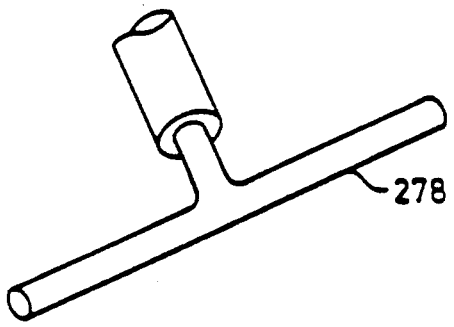
FIG. 26 is a perspective view of an alternative portion of an element shown in FIG. 24.

In an alternative embodiment as is shown in FIG. 26, the deploy rod 278 is formed with a "T"-shaped outward end providing additional stability while at the same time distributing the force exerted on the deploy rod in its extended position.

Figure 27:
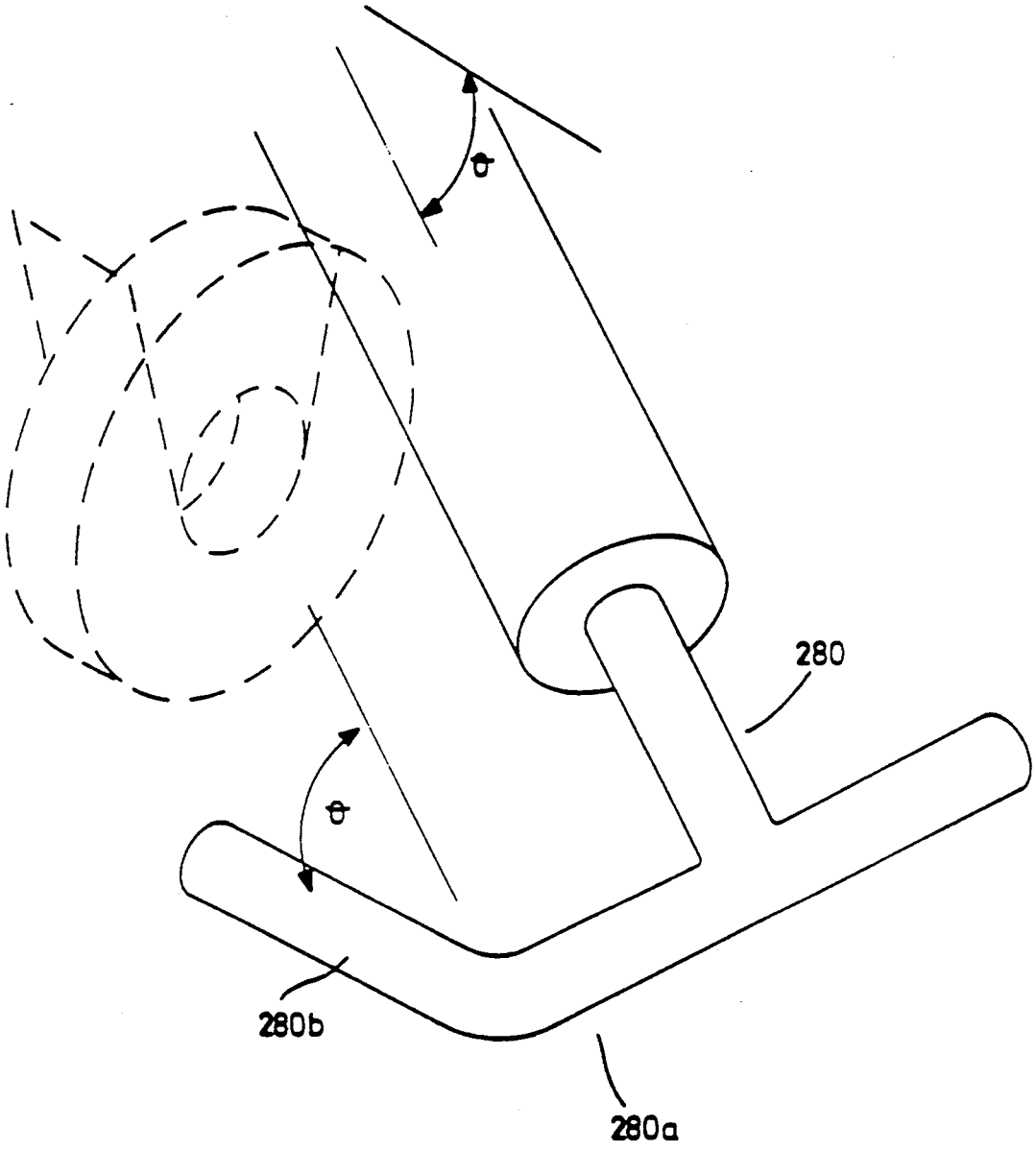
FIG. 27 is a perspective view of another alternative portion of an element shown in FIG. 24.
Figure 28:
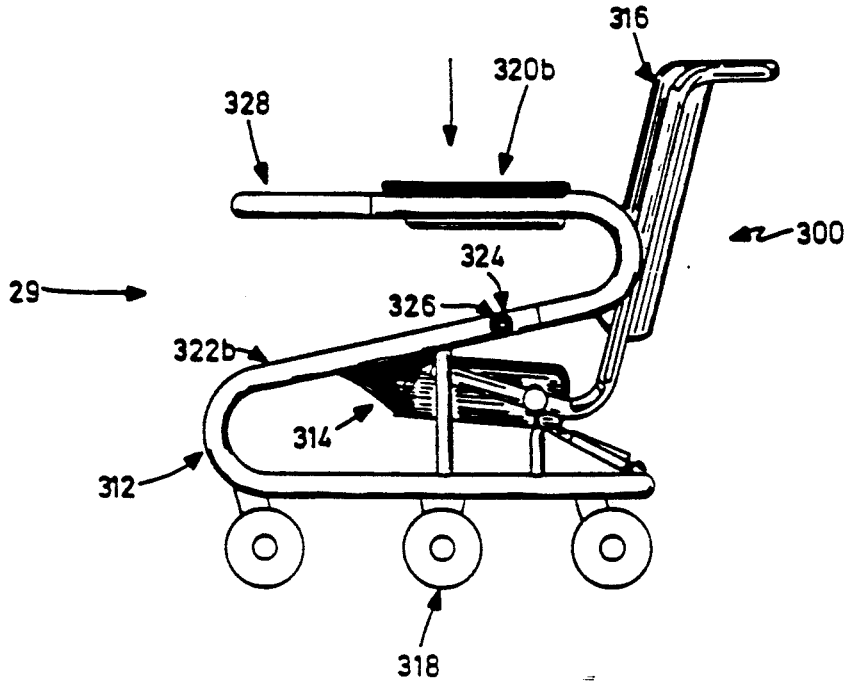
FIG. 28 is a side view of an alternative mobility device.
Figure 29:
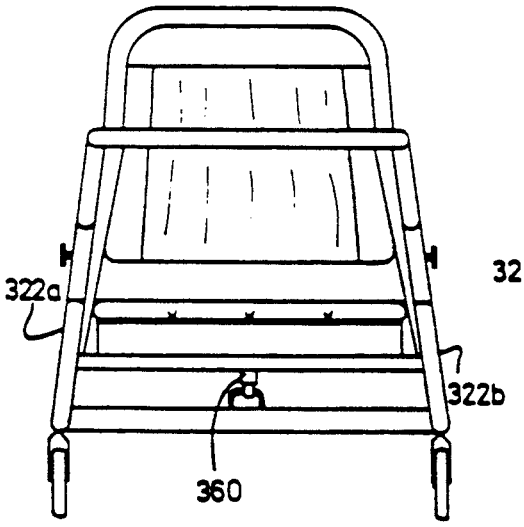
FIG. 29 is a front view taken on arrow 29 in FIG. 28.
Figure 30:
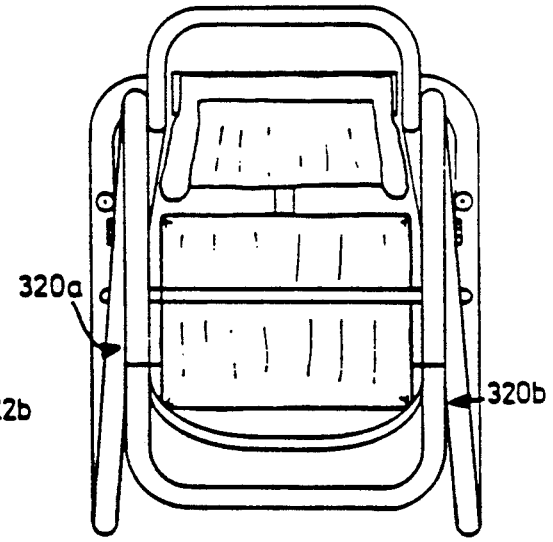
FIG. 30 is a plan view taken on arrow 30 of FIG. 28.

In another alternative embodiment as shown in FIG. 27, a deploy rod 280 has a "T"-shaped end, with one of the transversely extending arms 280*a* having a arm 280*b* extending inwardly at right angles to the transverse arm 280*a*. In addition, the inwardly extending arm is oriented at an angle o with respect to the axis of deploy rod 280, angle o corresponding to the angle in which the deploy rod 280 is located relative to the horizontal in the outwardly extended position. In this manner the deploy rod 280 provides further support to the outrigger in its extended position located adjacent the front or rear wheel.

In addition, any number of outriggers may be located on the side of the walker. For example a convenient combination involves the placement of an outrigger adjacent each wheel.

Alternative arrangements are also considered for the harness 230 including six or more belts 234 to provide further support to the user. Also contemplated is the use of different types of belts 230 such that the front belts have a different spring rate constant than the rear belts, thereby providing easier flexibility of the harness in one direction than in the other. For example, the use of a higher spring constant in the rear pair of belts enables the user to flex the harness in the rearward direction which preventing the user to flex easily the harness in the forward direction, thereby supporting the user against failing forward.

A further embodiment is illustrated in FIGS. 28 to 35 in the form of a chair 300. The chair has a frame 312 on which is positioned a seat 314 and a back 316, with the frame being supported by a wheel assembly 318. The wheel assembly 318 is of the same nature as those in the previous embodiments and will hereinafter not be discussed.

The frame 312 includes arm portions 320*a*, 320*b* which are respectively connected to base portions 322*a*, 322*b* at an interconnection 324. The interconnection is provided by a swaged end formed on each of the arm portions and inserted into the end of the respective base portion. A screw element 326 establishes the tight engagement between the respective arm portion and base portion. A tray identified at 328, joins the upper ends of the arm portions 320*al* 320*b*.

Figure 31:
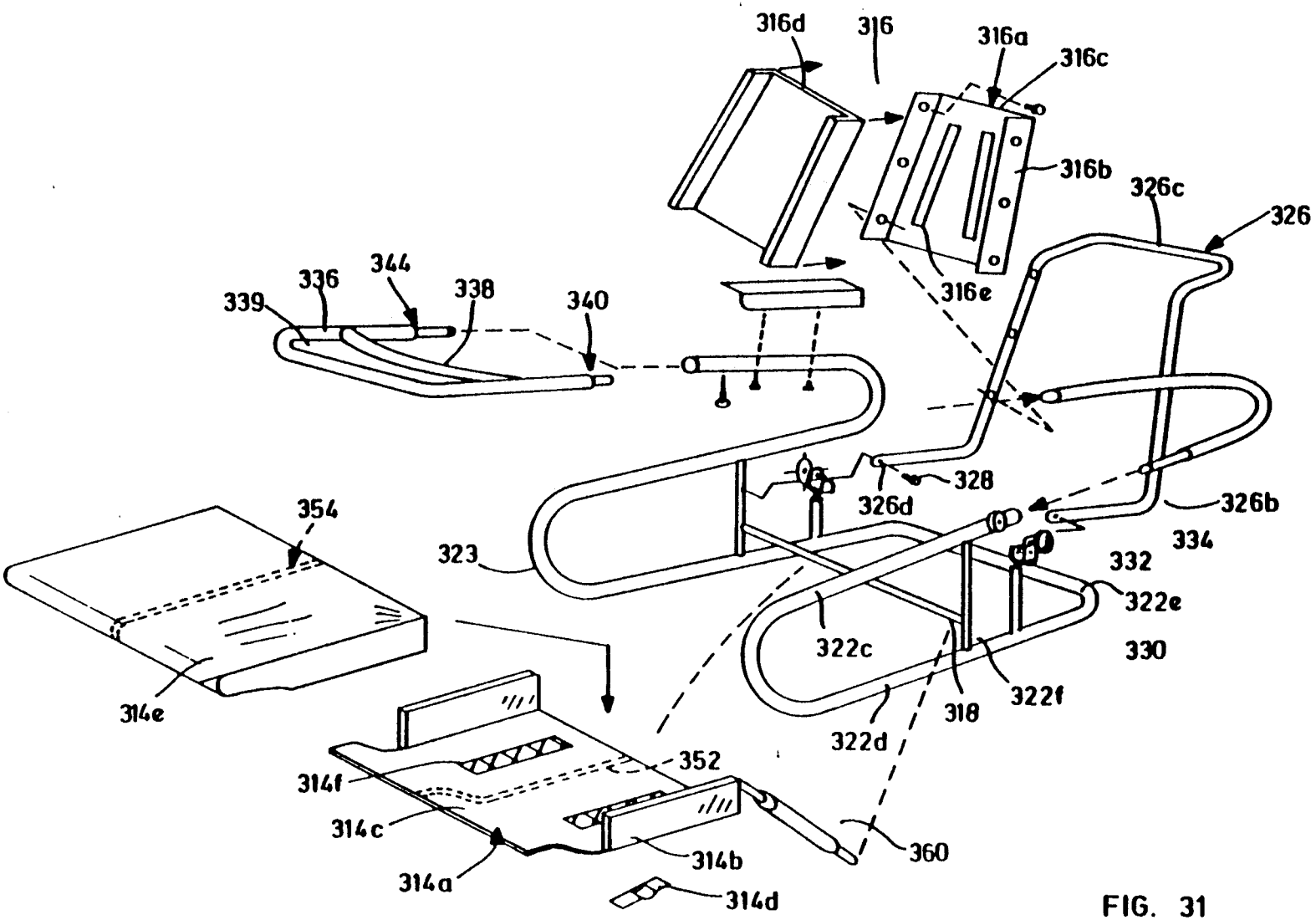
FIG. 31 is an exploded view of a portion of the device illustrated in FIG. 28.
Figure 32:
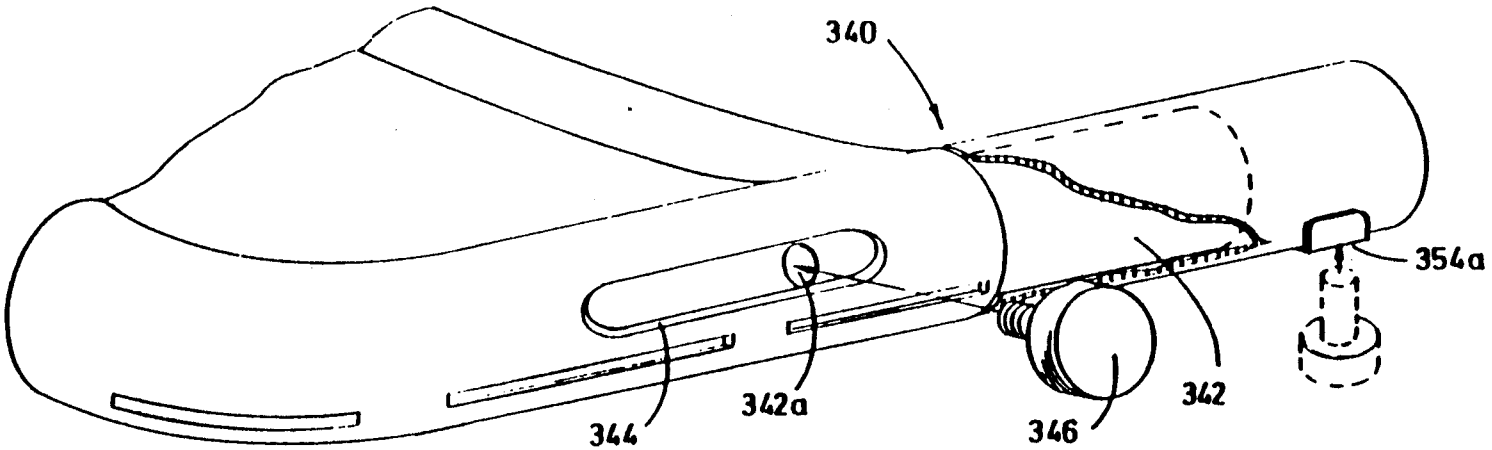
FIG. 32 is a fragmentary perspective view of one portion of the device illustrated in FIG. 28.
Figure 33:
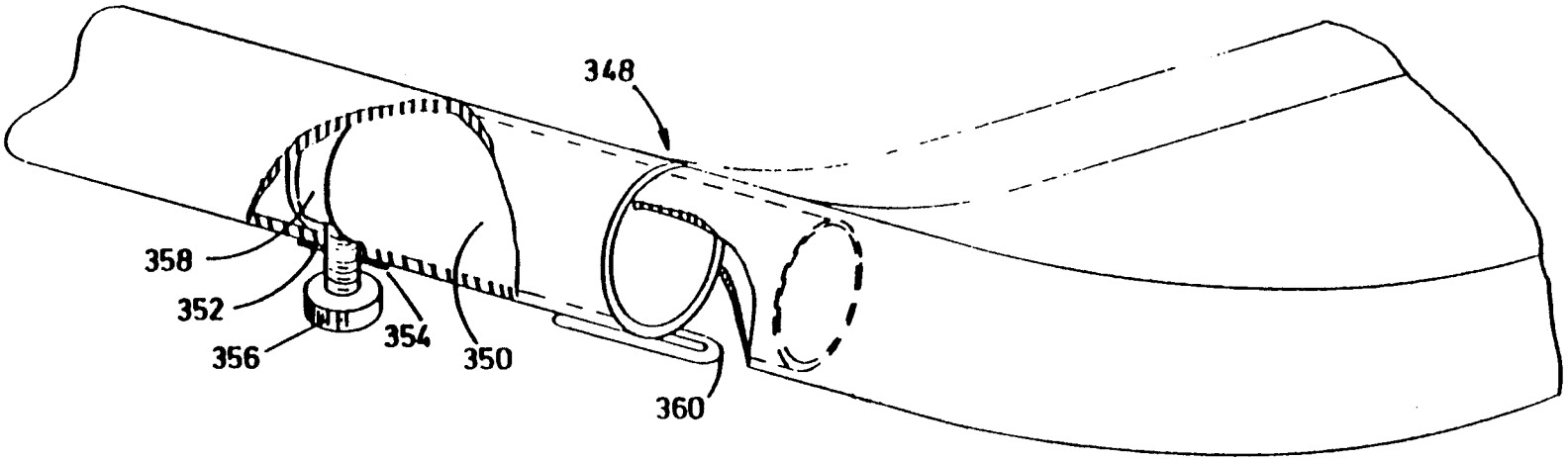
FIG. 33 is a fragmentary perspective view of another portion of the device illustrated in FIG. 28.

As is shown in more detail in FIG. 31, each of the base portions includes an inclined segment 322*c* and a horizontal segment 322*d*, with the horizontal segments being joined by a transverse segment 322*e*. The inclined horizontal and transverse segments are joined in continuous fashion and formed by a single tubular element which is bent to form the respective sections. In the bent region between the inclined and horizontal segments 322*c* and 322*d* respectively is a hole 323 to which is attached a foot rest of the type illustrated in previous embodiments. One of a pair of supports 322*f* joins the respective inclined segment with the adjacent horizontal segment. Pivotally mounted to the support 322*f* is a back support portion 326 formed of angular segments 326*a*, 326*b* which depend from a transverse segment 326*c*. A hole 326*d* is formed at the remote end of each of the respective angular segments to locate a tightening screw 328 which is threadably engaged with the respective support 322*f*. The horizontal segment 322*d* is also provided with a support post 330 which carries brackets 332 to locate the back support relative to the frame. Each of the brackets 332 includes spaced flanges 332*a* with a tightening screw 334 threadably engaged with one of the spaced flanges to engage the side wall of a respective angular member. As shown in FIG. 341 the support post 330 is height adjustable by way of a rod portion 330*a* in threaded engagement with a cylindrical portion 330*b*.

The back 316 includes a body 316*a* formed from a pair of side walls 316*b* joined to a transverse wall 316*c*. A cushion 316*d* is coupled to the transverse wall 316*c* by attaching a pair of complementary Velcro straps 316*e* located on the rear and front faces respectively of the cushion 316*d* in the transverse wall 316*c*. The seat 314 is positioned relative to the frame 322 by way of a transverse bar 318 which extends between the supports 322*f*. The seat 314 includes a base 314*a* having vertical side walls 314*b* upwardly extending from the lateral edges of a bottom panel 314*c*, a front portion of which is upwardly inclined in advance of the side walls 314*b*. A pair of brackets 314*d* engage the lower face of the transverse bar and are attached to the bottom panel 314*c*. A cushion 314*e* is of a shape complementary to the base 314*a*, and is connected thereto by way of complementary Velcro straps 314*f* positioned on the respective surfaces.

The tray 328 is formed from an outer peripheral frame member 336, the respective ends of which abut the ends of the arm portions 320*a*, 320*b*, and an inner peripheral frame member 338 which is padded to offer protection against user injury. A panel 339 extends between the inner and outer frame members to provide a working surface. The tray has a first lateral end, identified at 340 in FIG. 32, which locates an insert 342 adjacent a longitudinal slot 344. The slot receives a tightening screw 346 which is threadably engaged with a hole 342*a* in the insert 342. The tray is also provided with a second lateral end 348 shown in FIG. 33 in which is welded an insert 350. A hole is provided in the lower face of the adjacent arm portion 320*a* and is identified at 352. Surrounding the hole is a support strap 354 which is threaded with the hole to receive a tightening screw 356 for abutment in an annular groove 358 formed near the remote end of the insert 350. Also formed on the end of the adjacent arm portion 320*a* is an abutment 360 formed from a bent wire which is welded to the lower face of the arm portion. It is also to be noted that the arm portion 320*b* is provided with a hole and the appropriate support strap identified at 354*a* in FIG. 32 in order to receive the insert 350 in an alternative configuration as will be described.

The chair 300 is provided.with a dampening mechanism 360 which is of the same form as that utilized in a previous embodiment and will therefore not be discussed in detail further.

In operation the chair offers a number of advantages for the user, including a back rest 316 which is easily adjustable relative to the seat 314. This is achieved by simply adjusting the height of the support post 330 to cause the back rest 316 to rotate about supports 322*f* in the desired manner. The back rest also may be easily folded to a horizontal position to reduce the volume needed for shipping simply by releasing the tightening screw 344 and rotating the back support frame about the supports 322*f*.

As in the previous embodiments, movement of the seat 314 is dampened by the dampening mechanism. However, it is to be noted that rotational limits of the chair may also be provided by way of a rotation limit device, and a spring may be used to bias the seat to a desired orientation.

The tray also provides an enhanced versatility in that it may be pivoted from the operative position as shown in the drawings to a vertical orientation depending from arm portion 320*a* simply by displacing the insert 342 in a forward direction. This is done by releasing tightening screw 346 and displacing the same forward along the slot 344 until the end of the insert 342 is removed from the arm portion 3200. The tray may then be pivoted about the insert 3441 by releasing slightly the tightening screw 356. The rotation of the tray beyond the vertical depending orientation is inhibited by the abutment 360.

The tray 328 has the additional feature in that it may be reversed to permit the tray to be pivoted to a vertical depending position from the arm portion 320*b*. In this case, the tightening screw 356 is released from the hole 352 and placed in the appropriately threaded hole and strap 354*a* as earlier noted. The tray is first brought forward to withdraw the inserts 342 and 350 from the respective arm portions, then reversed to enable the inserts 342, 350 to be placed in the opposite arm portions thereby aligning the annular groove 358 with the repositioned tightening screw 356.

If desired, the seat 314 may be split along a centre line parallel to the central axis of the frame portions, as is shown by dashed lines 352, 354. In this case a dampening mechanism 360 would be provided for each of the seat portions formed by such a separation. This would enable independent rotation of the seat segments which is considered particularly important in the case of stroke patients, as well as to geriatric patients, by providing exercise to the upper legs about the hips.

Figure 34:
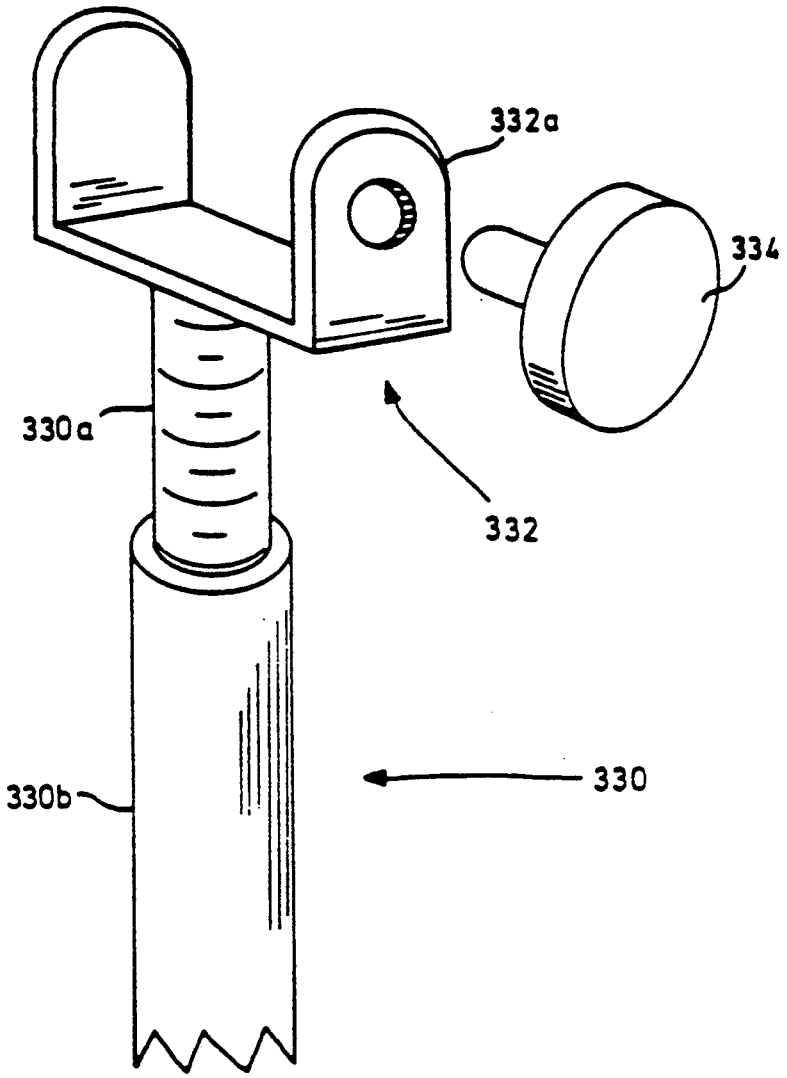
FIG. 34 is a perspective view of another portion of the device illustrated in FIG. 28.
Figure 35:
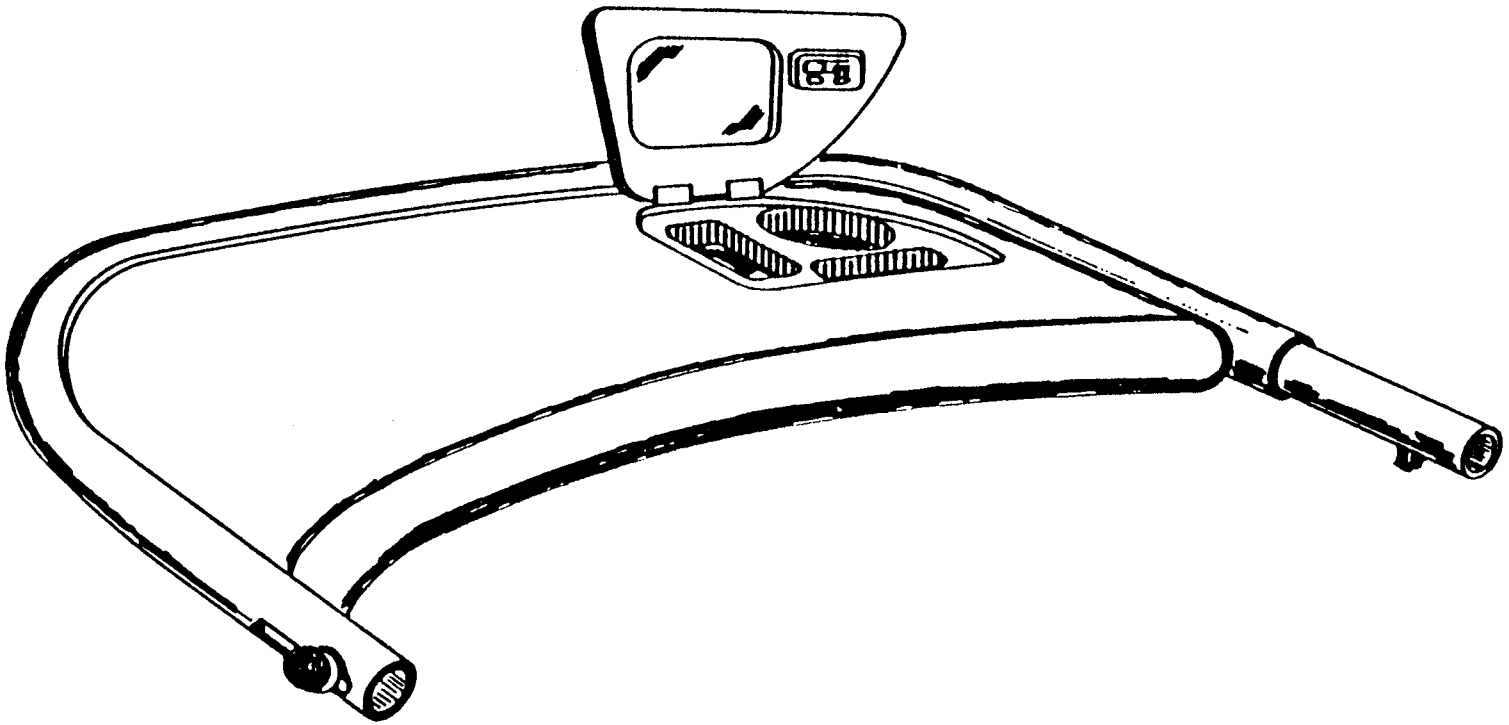
FIG. 35 is an alternative to a portion of the device illustrated in FIG. 28.

Also contemplated is the use of a number of accessories in the panel of the tray as shown in FIG. 34, namely a cosmetic kit with a digital clock or vanity mirror, or an intercom, not shown.

Although not shown, the support post 330 may be height adjustable to a number of preset heights, thereby allowing the back support portion 326 to be oriented in a corresponding number of preset orientations relative to the chair.

An alternative chair is illustrated at 410 in FIGS. 36 to 42. The chair has a frame assembly 412 including a rear frame portion 414 to support a seat 416, a back 418 and a user support assembly 419*t* which is also coupled to the seat to allow coordinated movement therebetween as will be described, The frame assembly 412 has a pair of right and left hand front frame positions 420*a*, 420*b* which are removably attached to the right and left hand sides respectively of the rear frame portion 414 by a pair of attachment assemblies 422*a*, 422*b*. The frame assembly 412 also supports the wheel assembly 423 and a foot rest assembly 424, as will be further described.

Referring in more detail to FIG. 421 the rear frame section 414 has right hand and left hand segments 426*a*, 426*b* respectively which are formed from a continuous tubular member. Each of the right hand and left hand segments has an upper portion 428 which is inclined slightly downwardly toward a lower horizontal portion 430, while a central portion 432 joins their respective front ends and is inclined slightly rearwardly from the vertical. A back support portion 434 depends from the rear end of the upper portion 428 and has a forwardly cantilevered seat support portion 436. An upper transverse member 438 joins the front ends of the seat support portions 436 while a lower transverse member joins the rear ends of the-lower portions 430.

Each of the right and left hand front frame portions 420*a*, 420*b* includes upper and lower portions 444, 446 which are parallel to the respective inclined and horizontal portions of the rear frame portion, and are joined at their front and rear ends respectively by front and rear portions 448, 450 which are oriented parallel relative to the central portion 432.

Figure 41:
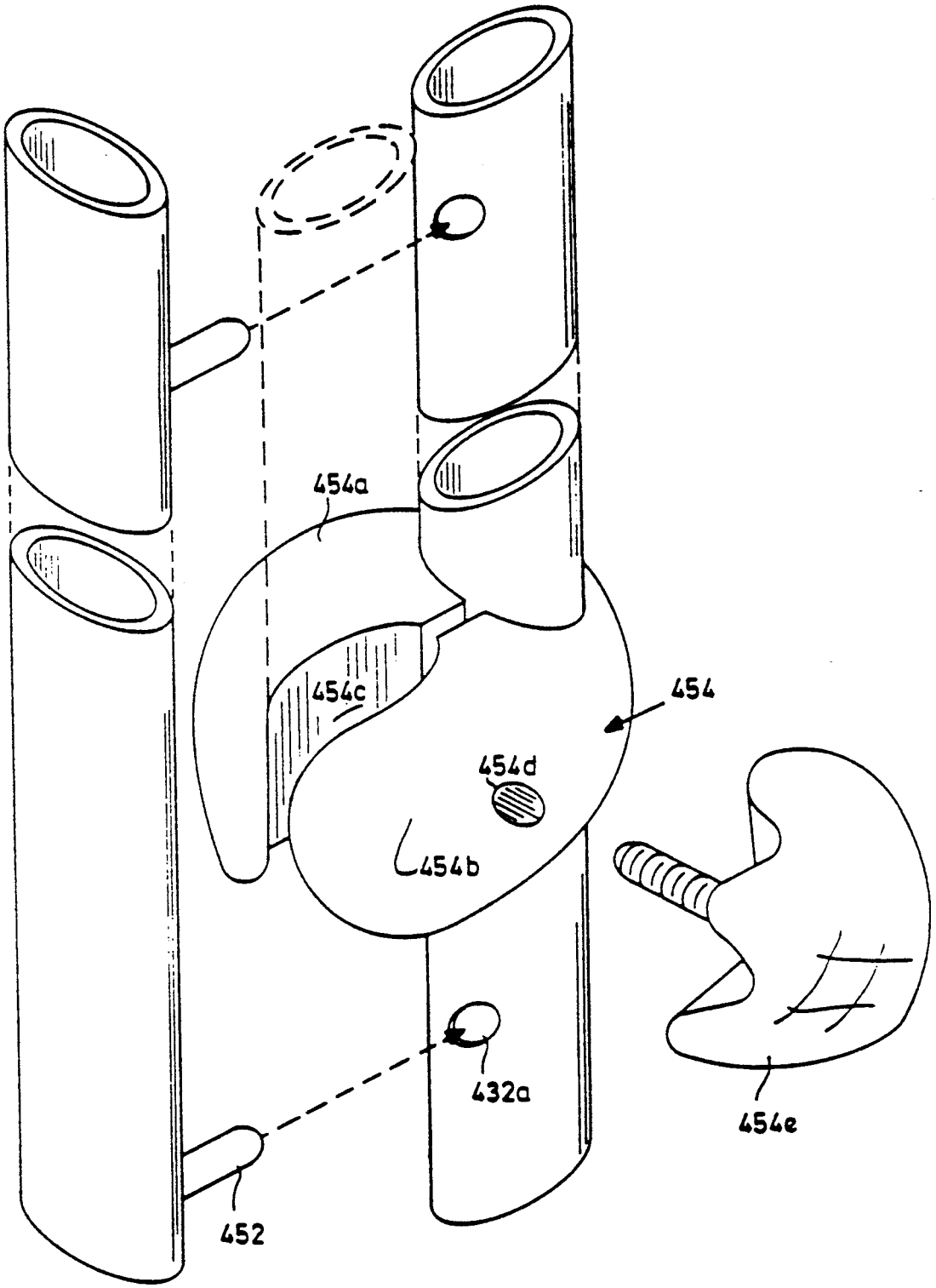
FIG. 41 is a fragmentary perspective view in partial assembly form of another portion of the device illustrated in FIG. 36.

The features of the attachment assemblies 422*a*, 422*b* are shown in more detail in FIG. 41 and include a pair of pins 452 extending from the rear face of the rear portions 450 to be inserted into corresponding holes 432*a* formed in the front face of the central portions 432. A ball clamp 454 encompasses the laterally inner and outer peripheries of the central and rear portions and is formed by a pair of clamp segments 454*al* 454*b*. Each of the segments has am inner surface 454*c* complementary with the outer surface of the respective portion, while holes are provided at 454*d* to receive a tightening screw 454*e*.

Figure 36:
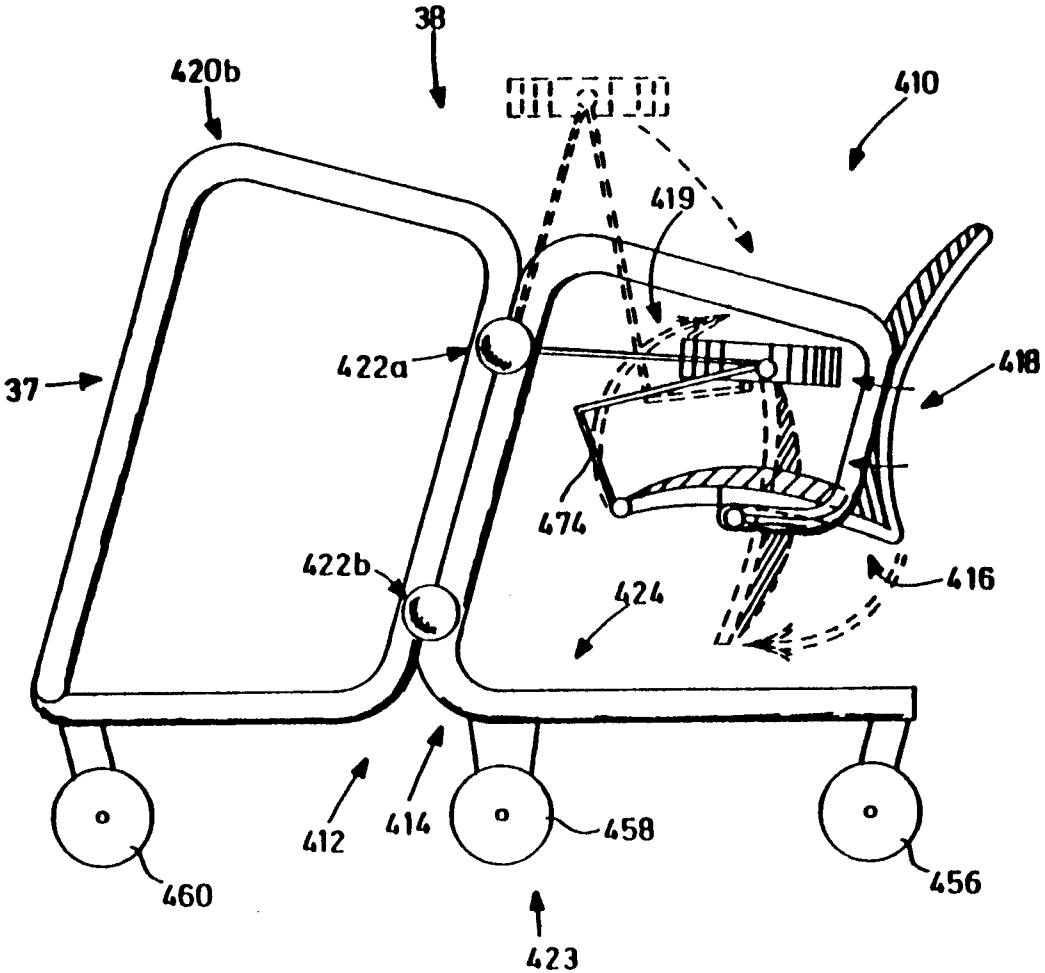
FIG. 36 is a side view of an alternative mobility device.
Figure 37:
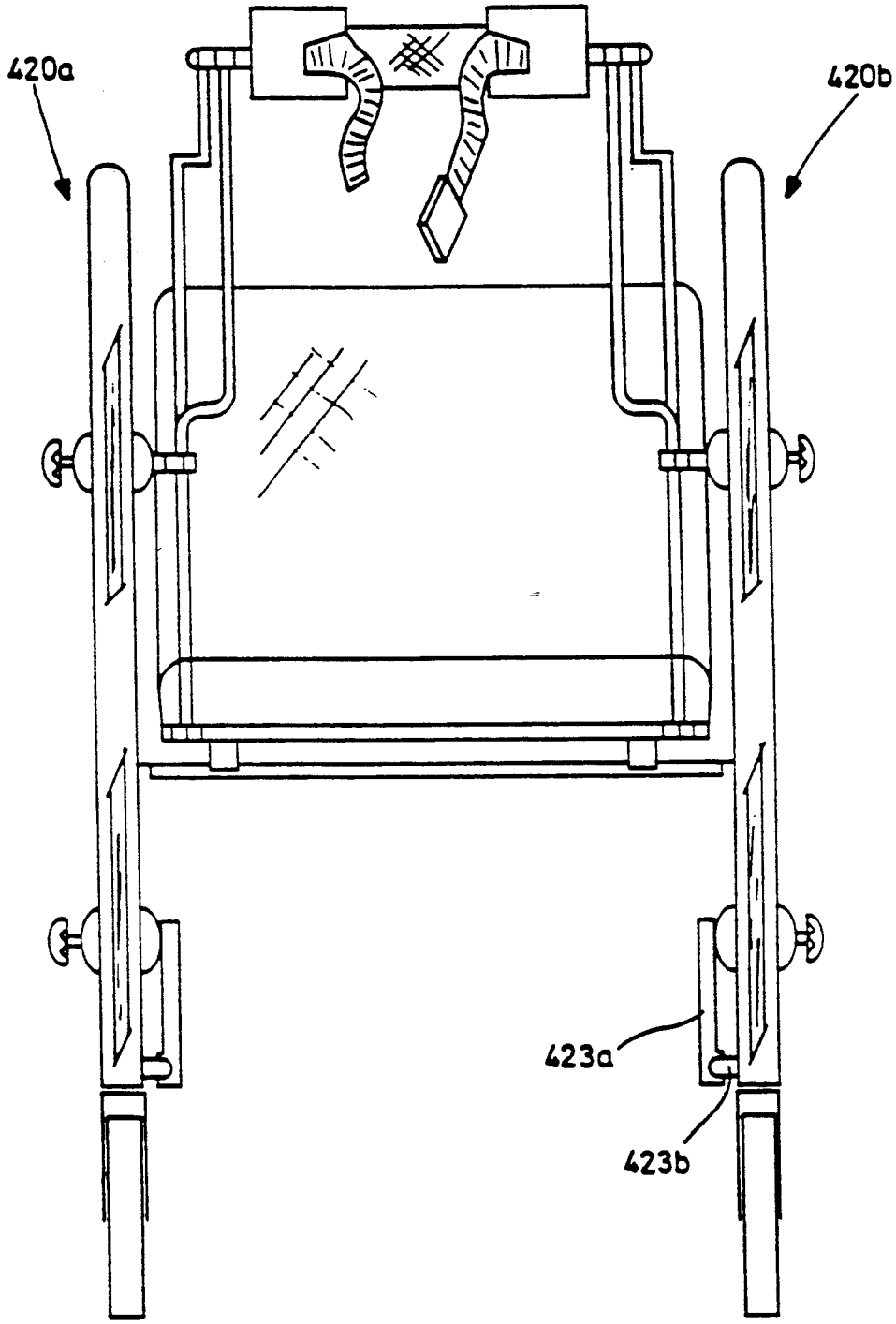
FIG. 37 is a front view taken on arrow 37 of FIG. 36.
Figure 38:
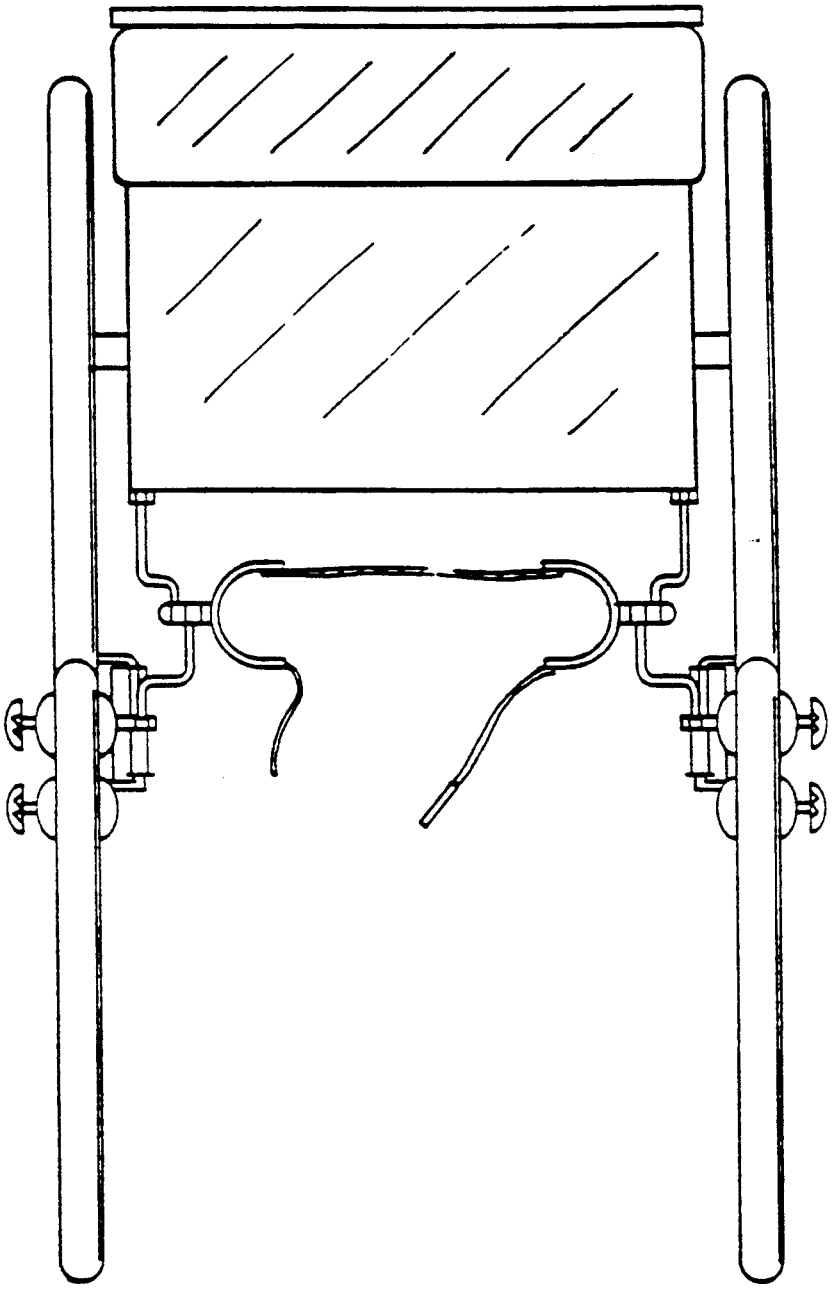
FIG. 38 is a plan view taken on arrow 38 of FIG. 36.

As is shown in FIG. 36, a rear caster wheel 456 and a middle fixed wheel 458 are provided on the lower portion 430, while a front caster wheel 460 is positioned at the front of the lower portion 446. The wheel assembly 423 operates in the same manner as in previous embodiments and will thus not be described further.

Each of the lower portions 430 also supports a pair of foot assemblies 423, which include a foot rest member 423*a* pivotally mounted on a shaft member 423*bl* the ends of which are bent so as to be attached to the corresponding inner side face of the lower portion 430.

Figure 39:
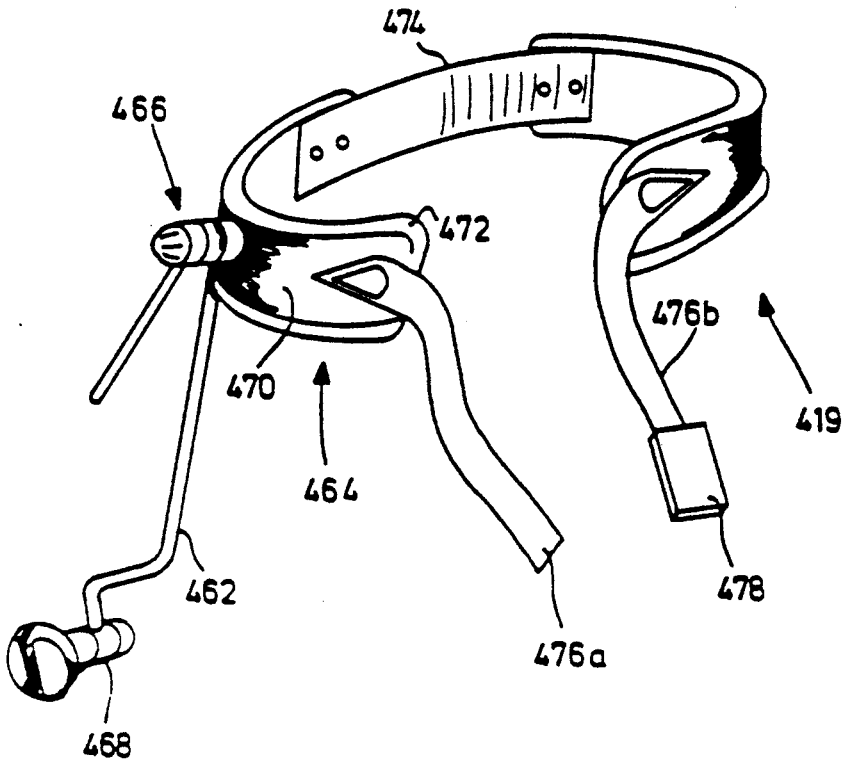
FIG. 39 is a perspective view of a portion of the device illustrated in FIG. 36.

A particular feature of the chair 410 is the user support assembly 419 which is illustrated in more detail in FIG. 39. A support member 462 is pivotally mounted to the upper ball clamp element 454*a* and to a belt 464, by way of pivot mechanisms 466 and 468. The belt 464 is formed from a pair of rigid curved panels 470 with a foam liner 472 attached to each of their inner faces, and a stretchable pad 474 extending between their rear remote ends. A pair of straps 476*a* 476*b* extend from the front remote ends of the curved panels 470, with the strap 476*b* terminating at a buckle 478.

It can thus be seen that the user support assembly 419 is adaptable to a number of waist sizes. In addition, by virtue of its attachment to the ball clamp 454, the user support assembly 419 is height adjustable for a wide range of user waist heights.

Figure 40:
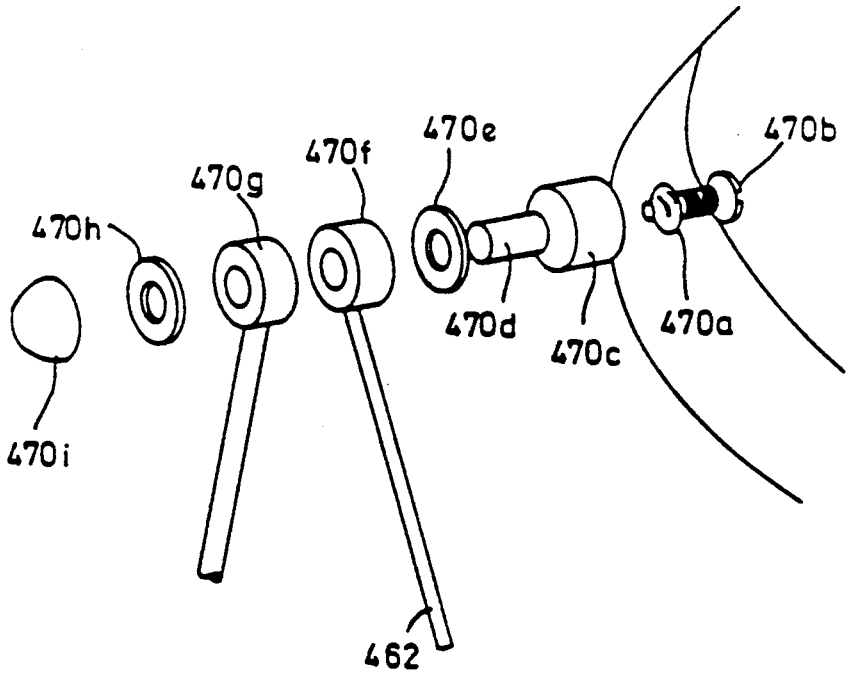
FIG. 40 is a fragmentary view of a segment of the portion illustrated in FIG. 39.

Reference is made to FIG. 40 illustrating the pivot mechanism 466 which is attached to the respective curved panel 470 by way of a hole 470*a* and a corresponding screw 470*b* extending through the hole to engage a bronze bearing shoulder 470*c*. A bearing surface 470*d* extends outwardly from the bearing shoulder 470*c* on which is placed a nylon washer 470*e*, pivot elements 470*f*, 470*g*, a washer 470*h* and a threaded cap 470*i*, the threaded cap being threaded to the remote end of the surface 470*d*. The pivot element 470*f* is fixed to the upper end of the support member 462 while the pivot element 4709 is attached to a lever as will be discussed.

Figure 42:
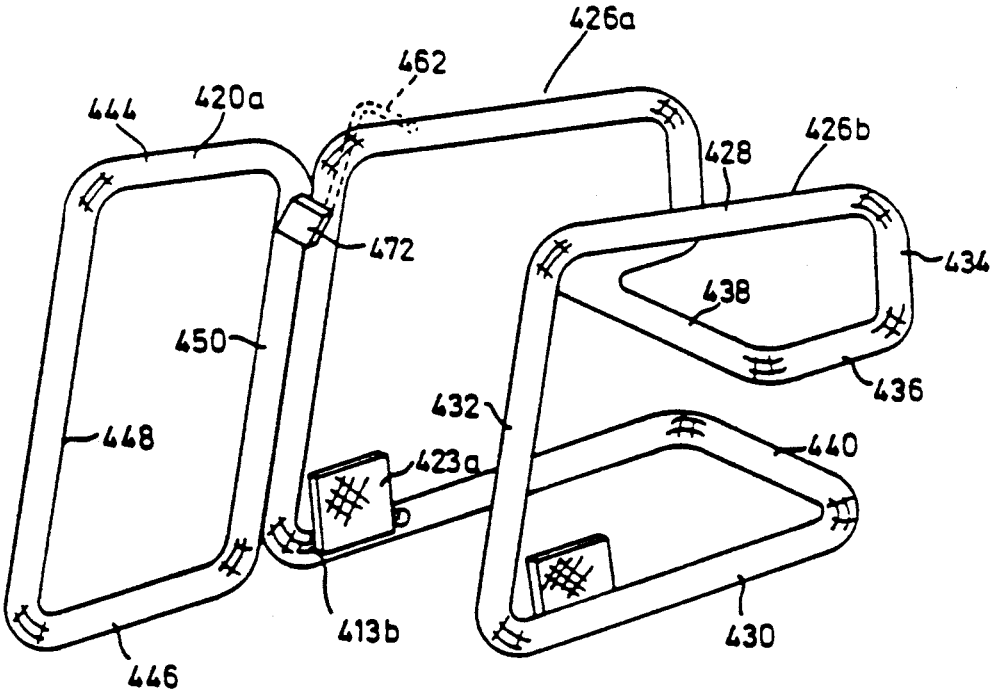
FIG. 42 is a perspective view of yet another portion of the device illustrated in FIG. 36.

The pivot mechanism 468 is equivalent in structure to the pivot mechanism 466 with the exception that the shoulder 470c is mounted to the inside ball clamp member 454a. In addition, a pivot element corresponding to 470f is not used in pivot mechanism 468. With reference to FIG. 42, there is also provided a block 472 affixed to the inner surface of the rear frame portion 450 for limiting forward movement of the support member 462.

Joined to the pivot element 470g on each side of the belt 464 is one end of a lever member 474, while the other end is pivotally mounted to the front end of the seat 414 to coordinate movement of the support assembly with the seat as will be described.

In use, the user enters the chair from the front between the frame sections. The support assembly 419 is then strapped around the user's waist with the appropriate adjustments made for height and width by way of the upper ball clamps 454 and the buckle 478 accordingly. The user may then operate the chair in a standing positions wherein the lever member 474 ensures that the seat 414 is in a storage position so as not to interfere with the movement of the user. The user is then free to manoeuvre the chair in the desired direction so as to exercise his legs while grasping the upper frame portions for support.

Should the user inadvertently fall forward, the blocks 472 prevent the rotation of the support member 462, thereby preventing his falling forward in the chair. Alternatively, should the user fall backward, the levers 474 are displaced downwardly to cause corresponding rotation of the seat 414 to the operative position. At the same time, the support member 462 ensures the safe alignment of the users buttocks with the seat 414.

The removable nature of left and right hand front frame portions 420at 420b not only reduces the space requirements for shipping, but also allows the chair to be used in one of two configurations. In place the right and left front sections 420a, 420b provide a support rail extending in front of the chair 410, by way of upper portions 444. Being inclined, the support rail allows the user to support himself in a comfortable stance at a range of locations depending on his height, arm length and the like, while at the same time provides additional support for the user when entering the chair 410.

With the left and right front frame portions 420a, 420b removed, the user is provided with a lightweight and compact wheel chair.

A further feature of the chair 410 is the inherent flexibility afforded by the rectangular spiral shape of the frame frame portions 426a, 426b, which serves to absorb vibrations in the rolling surface, while reducing the force of impact should the user fall.

Figure 45:
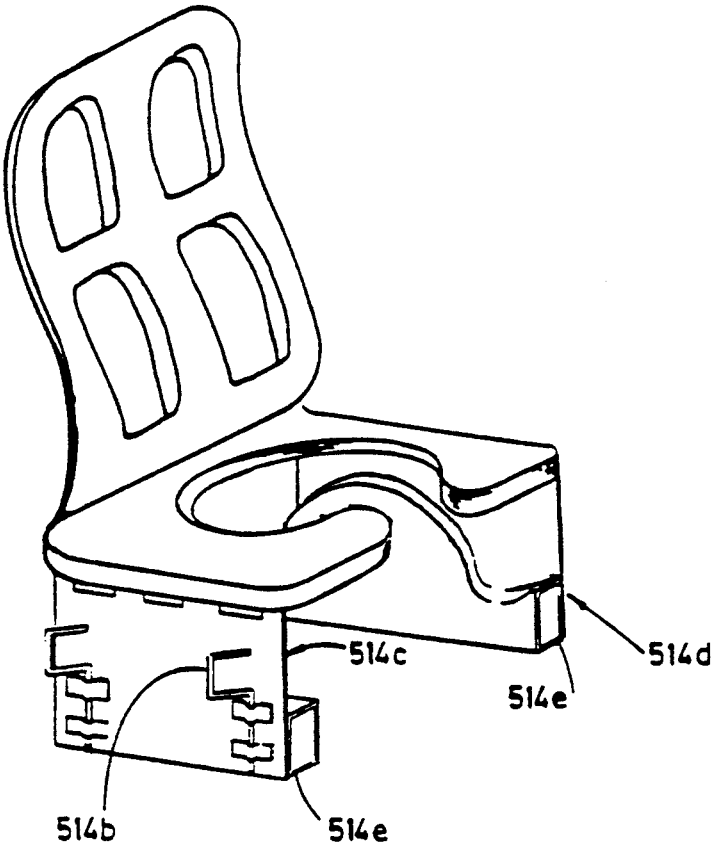
FIG. 45 is a perspective view of a portion of the device illustrated in FIG. 45.
Figure 43:
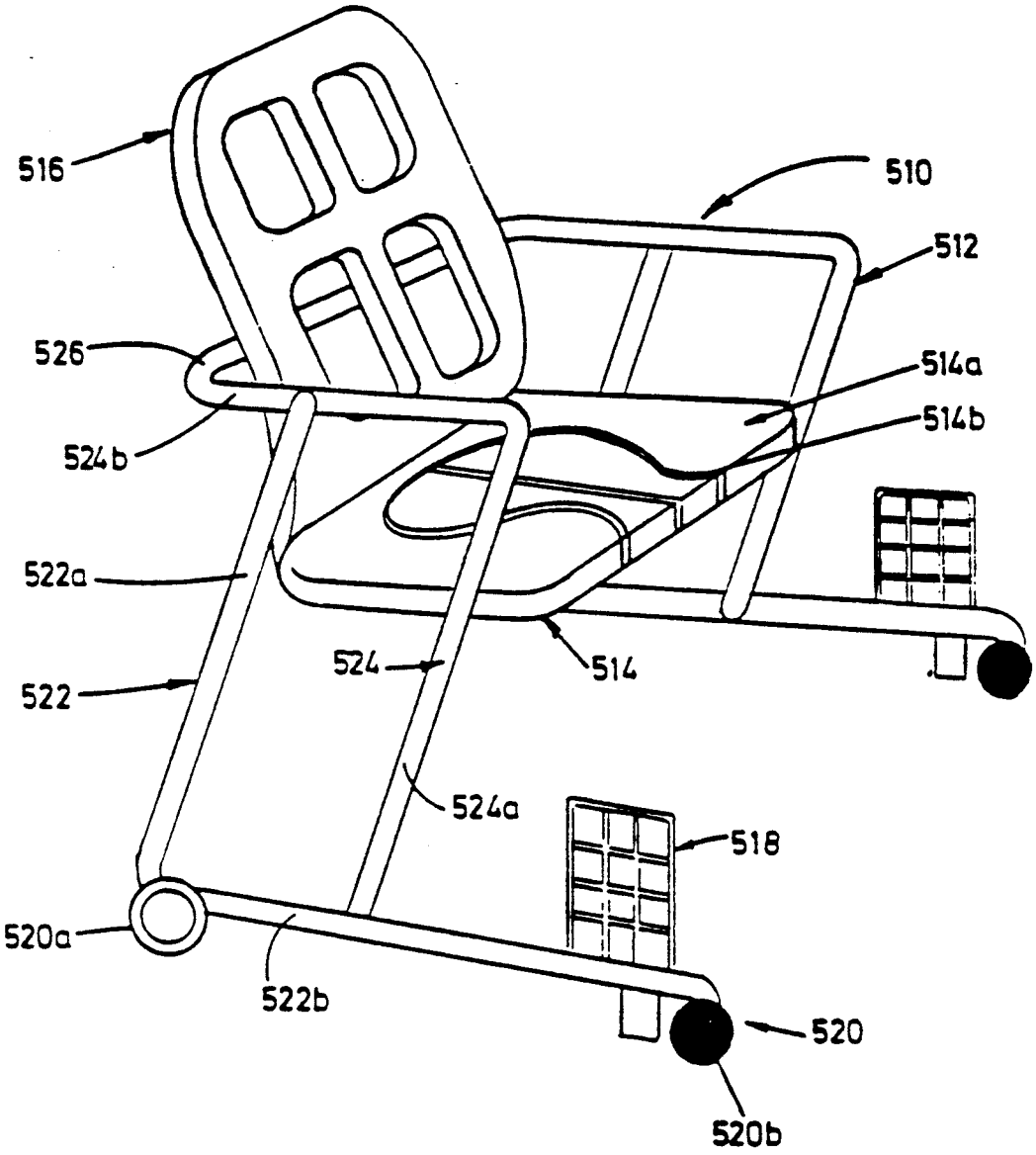
FIG. 43 is a perspective view of yet another alternative mobility device.
Figure 44:
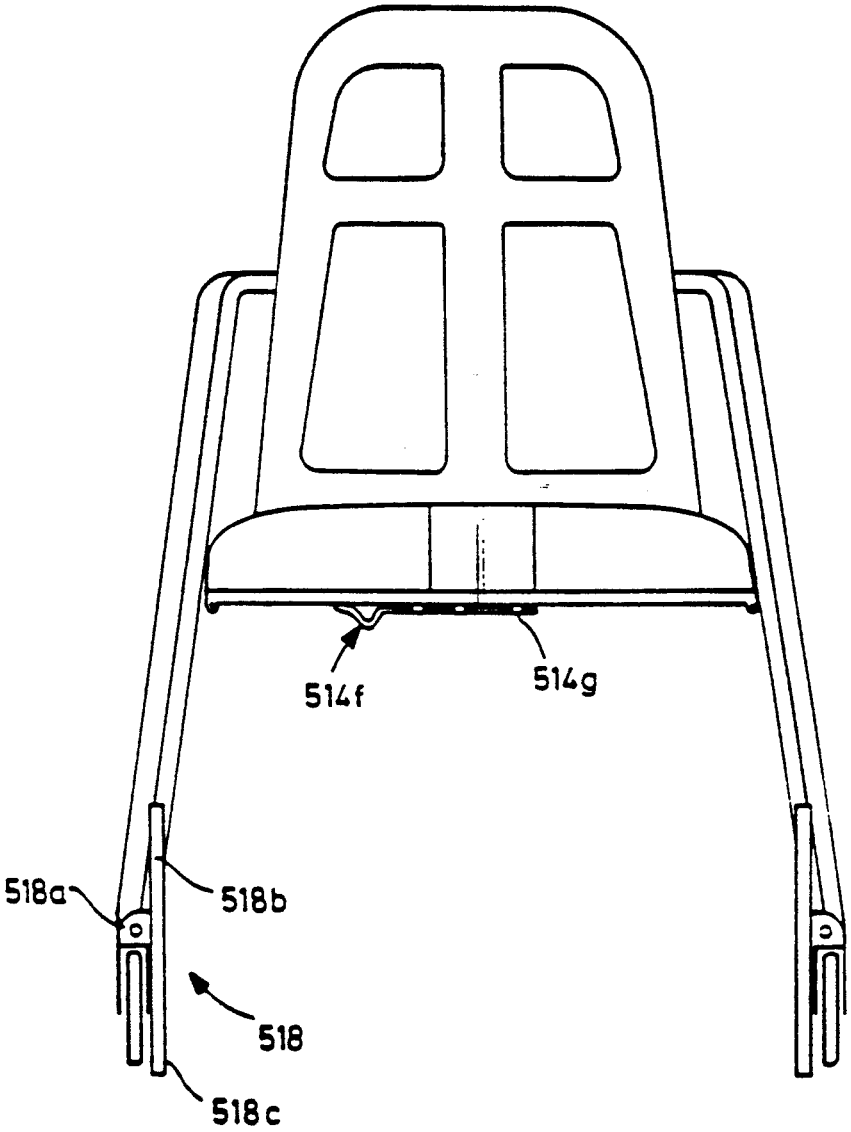
FIG. 44 is a frontal view of the device illustrated in FIG. 43.

With reference now to FIGS. 43, 44 and 45, an alternative chair is illustrated at 510 having a frame 512 which supports a seat 514, a back 516, foot rests 518 and a wheel assembly 520, all of which will be described.

The frame 512 is formed from left and right hand angular members 522, each of which has a vertical portion 522a and a horizontal portion 522b, the latter carrying a fixed axle wheel 520a at its rear end, and a caster wheel 520b at its front end. An inverted angular member 524 is attached to the laterally inner face of the respective angular member 522 and includes a vertical portion 524a and a horizontal portion 524b extending rearwardly from the vertical portion 524a. The rear end of each of the horizontal portions 524b are joined to a transverse member extending behind and to which is attached the back 516.

A particular feature of the chair 510 is the seat 514 which is provided for use as a replacement to or in conjunction with a toilet. Provision is made in a body 514a of a passage 514b with panels 514c and 514d hinged near the lateral edges of the body, with the remote end of each panel having a formation 514e thereon. The formation 514e is complementary to a half section of the passage so as to close the passage when the panels 9.2, re in aligned position with the body 514e. A pair of latches 514f are slidably mounted on the panel 514e to engage eyelets 514g on the hinged panel 514d so as to maintain the panels in the aligned position.

The foot rests 518 include a sleeve portion 518a is slidably mounted near the front end of each of the horizontal portions 522b and has an outwardly extending foot plate 518b, shown in the stored position in the drawings. Extending in the opposite direction to the foot plates 518b are wheel lifts 518c which serve to disable the caster wheels 520b when the chair is stationary. This is provided to minimize user injury when approaching or leaving the chair.

While the chair is lightweight and rigid to offer suitable support to the user, the upwardly tapered frame as shown in FIG. 441 allows the chair to be stacked on other chairs during storage. The open-ended frame also enables the passage to be aligned with a toilet bowl. Alternatively, provision may be made on the lower face of the base 514a to receive a catch basin, by way of tracks or other appropriate fasteners.

Moreover, the passage may be opened while the patient is sitting on the chair. In this manner, suitable support may be given to the patient while in transport to and from the toilet, while at the same time the passage may easily be activated without the need of removing the patient from the chair. In addition, the chair is applicable as a shower chair, provided of course the materials in making the chair components are selected accordingly.

Several alternatives exist for the foot rest 5181 including a foot rest which is formed from a wire grid, or other suitable structure to provide a friction covering, while at the same time the wheel lift 518c may be covered with a rubber material in order to enhance the frictional engagement with the ground.

Also contemplated is the use of a buzzer, not shown, placed on one of the horizontal portions to enable the user to seek help. While a number of features have been disclosed for each of the above embodiments, it is to be understood that the features may be appropriate for other or all of the embodiments.

Figure 46:
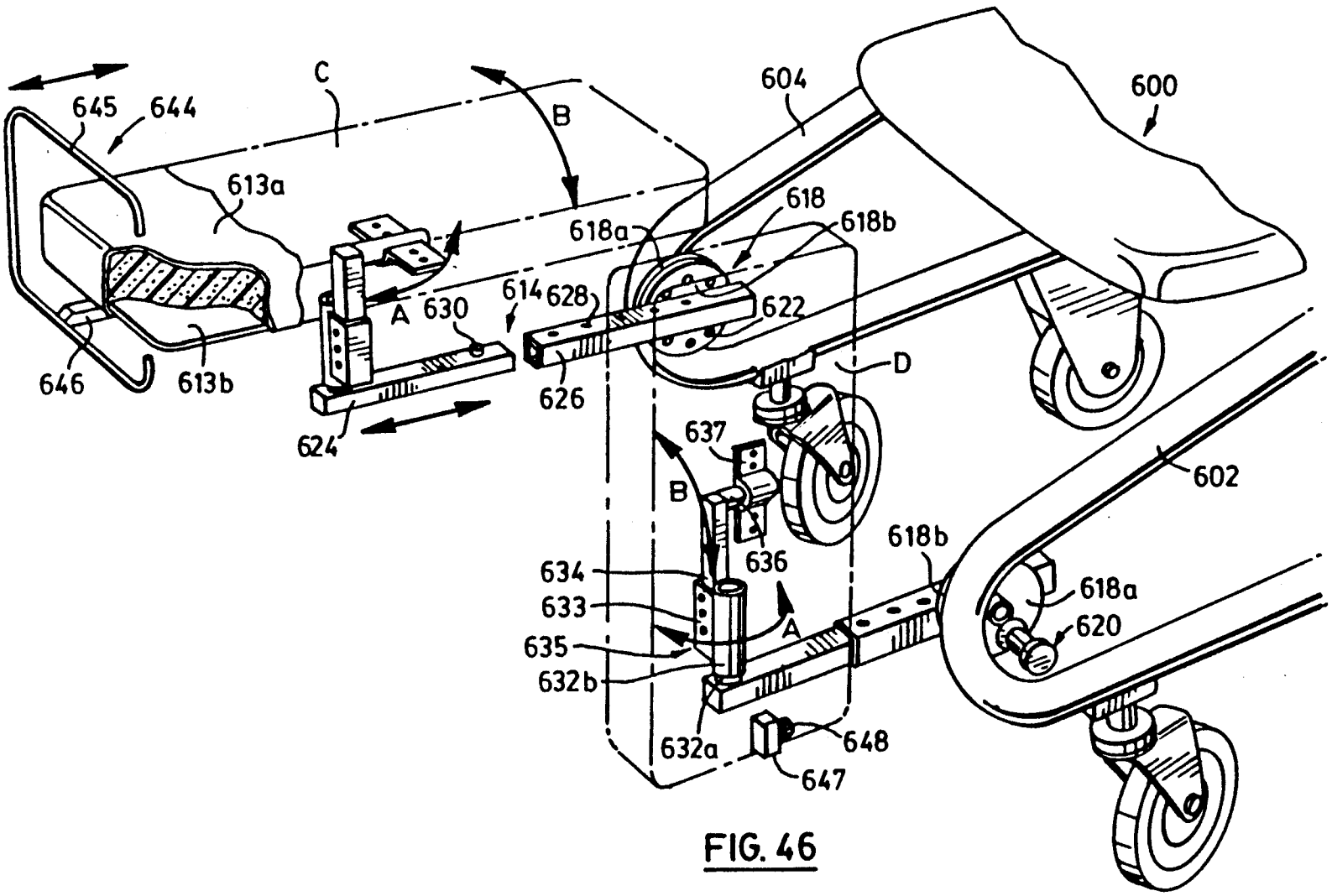
FIG. 46 illustrates a fragmentary perspective view of a portion of yet another alternative mobility device.

Another mobility device, in the form of a chair, is shown at 600 in FIG. 46. The chair has a left frame section 602 and a right frame section 604. Left and right footrests 612 are mounted on the frame sections 602,604 and are movable to a number of positions so that the footrests can perform different functions as shall be hereinafter described. A further particular feature that will emerge from the following discussion is that the left and right footrests are structurally identical and thus can be used on either side of the chair to simplify manufacture.

Each footrest 612 has a cushion 613a mounted on a base place 613b and has an extensible support assembly 614 providing movement in three planes. This movement is derived in part by a disc arrangement 618 joins the respective support assembly 614 with the left and right frame sections 602,604. One of the discs 618a is fixed to the lower corner portion of the respective frame section. A spring loaded pin 620 is attached to disc 618a and passes through a hole formed therein. The other disc 618*b* is provided with a number of circumferentially spaced holes to receive the spring loaded pin 620 therein.

The support assembly includes a first member 624 telescopingly engaged with a second member 626, the latter of which is fixed to the disc 618*b*. The second member 626 has a number of holes 628 along its length. The first member 624 has, at one end, a spring loaded ball 630 extending therefrom to pass through any one of the holes 628 corresponding to the desired length of the support assembly 614.

The first member 624 has at its opposite end a pair of upright nested cylindrical elements 632*a*,632*b*, the inner of which 632*a* is fixed to the first member 624. The other cylindrical element 632*b* is attached, along a line extending its length, to a third member 633 which, by virtue of the nested cylindrical elements, can pivot around the end of the first member 624 as shown by the arrows A.

The third member 633 is telescopingly engaged with a fourth member 634 and a pin and hole arrangement 635 is provided thereon which is identical to the arrangement formed by the holes 628 and ball 630. Thus, the position of the fourth member 634 relative to the third member 633 may be adjusted according to the desired height of the support assembly 614. A cylindrical element 636 is fixed to the free end of the fourth element 634. A clip 637 joins the cylindrical element 636 to the baseplate 613*b* so that the cushion 613*a* can pivot in the direction of arrows B.

Also provided on the footrest is a rectangular footguard 644 having a rectangular frame made from a bent rod 645 which is fixed to a rectangular cross-sectioned member 646. The member 646 is slidably engaged in either one of a pair of rectangular members 647 anchored to opposite ends of the baseplate 613*b* as shown on the left footrest of FIG. 46. This enables the footguard to be used on either end depending on the side on which the footrest is used. A turn knob 648 is threaded into each of the members 647 to fix the position of the footguard relative to the cushion 613*a*.

When used in the position C illustrated in FIG. 46, a pair of footrests are first adjusted for length and height by varying the positions of:

i) the disc 618*b* relative to the disc 618*a*;

ii) the first member 624 relative to the second member 626; and iii) the fourth member 634 relative to the third member 633;

The footguard may then be mounted on the end of the cushion which is farthest from the seat of the chair and the distance of the footguard is adjusted to provide a slight gap between the plantar surface of the user's foot and the footguard.

The user may then place the calf of his leg on the cushion 613*a* if desired, both footrests may be placed in the position C and thereby together serving as a foot stool to support both legs at the same time.

Figure 47:
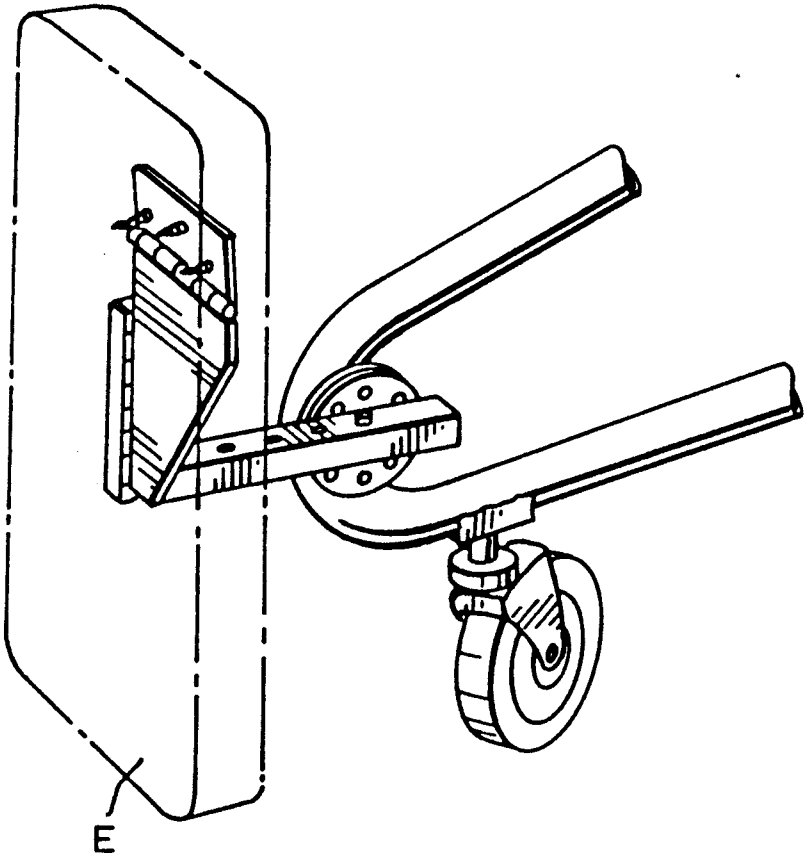
FIG. 47 is a fragmentary perspective of one element of the portion illustrated in FIG. 46 in another configuration.

The footrest may be pivoted from the position C to position D as shown for the left footrest in FIG. 46 wherein the footrest is in a substantially vertical position and parallel with the support assembly 614 and thus the frame sections 602,604. In this position, the footrest protects the ankles and the legs of the user from objects approaching the front of the chair while permitting easy access thereto. Furthermore, the footrests may be pivoted to a position E as shown in FIG. 47 wherein the footrest may function as a bumper, thereby protecting the user from injury due to contact with obstacles directly in front of the chair.

Figure 48:
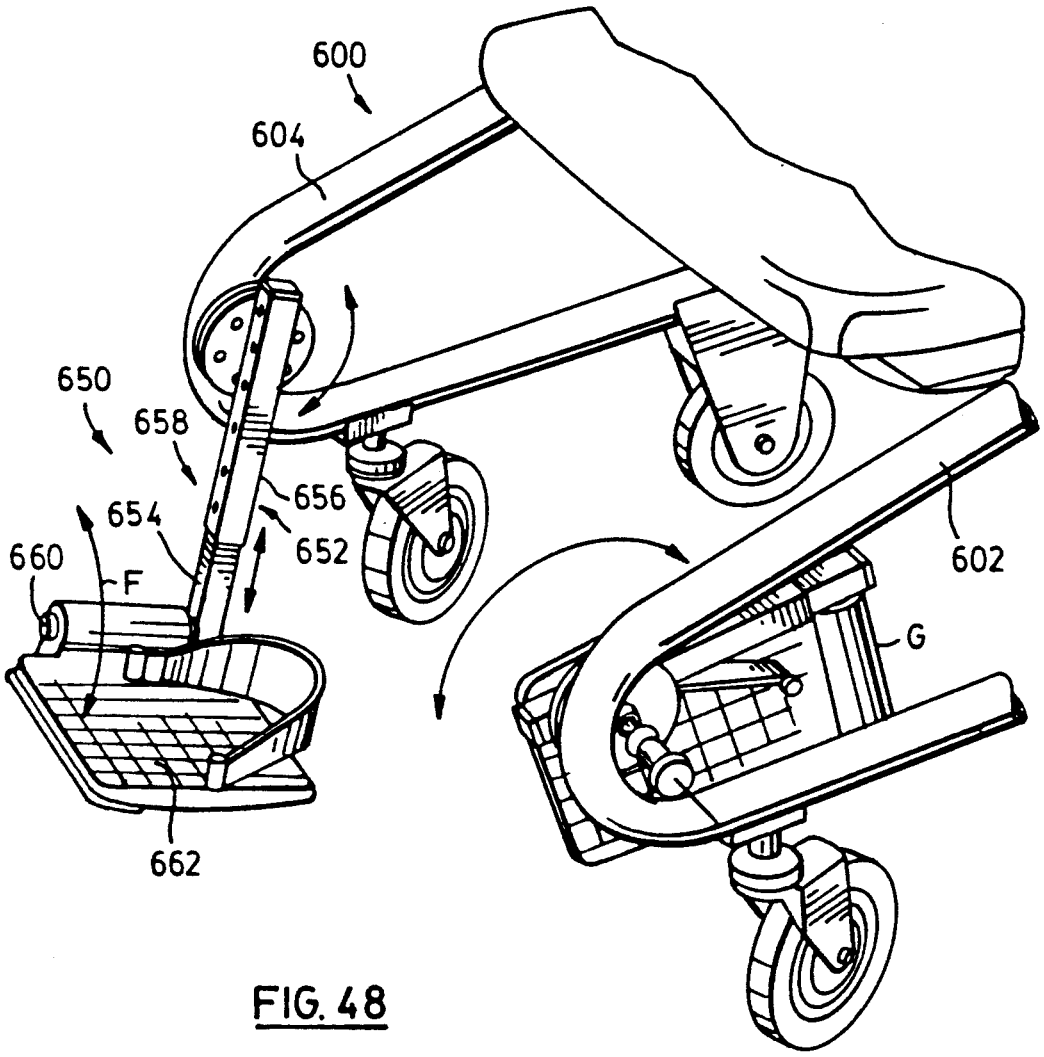
FIG. 48 is a fragmentary perspective view of a portion of yet another alternative mobility device.

FIG. 48 shows yet another footrest assembly 650 used on the chair 600. Herein, the footrest has a frame assembly 652, with an inner frame member 654 and an outer frame member 656 telescopingly engaged together and positionable by way of a spring loaded ball and hole arrangement 658, identical with that discussed hereinabove. The outer frame member 656 is attached to one of a pair of discs identical to those discussed hereinabove. Attached to the remote end of the inner frame member 654 is a pivot rod 660. A footpad 662 is pivoted on the rod 660 for movement as shown by arrow F in FIG. 48.

The footpad 662 is formed by injection molding a resilient material around a metal pad so that substantially all surfaces of the footpad, that can be contacted by the user's foot or leg, are cushioned. This provides an inexpensive footrest while at the same time offering comfort and protection to the user. This protection is enhanced by the adjustability of the footrest to a position as illustrated at G wherein the footrest prevents the front caster wheel adjacent the footrest from passing into the free region between the frame sections 602,604 colliding with the feet of the user and causing injury.

Figure 50:
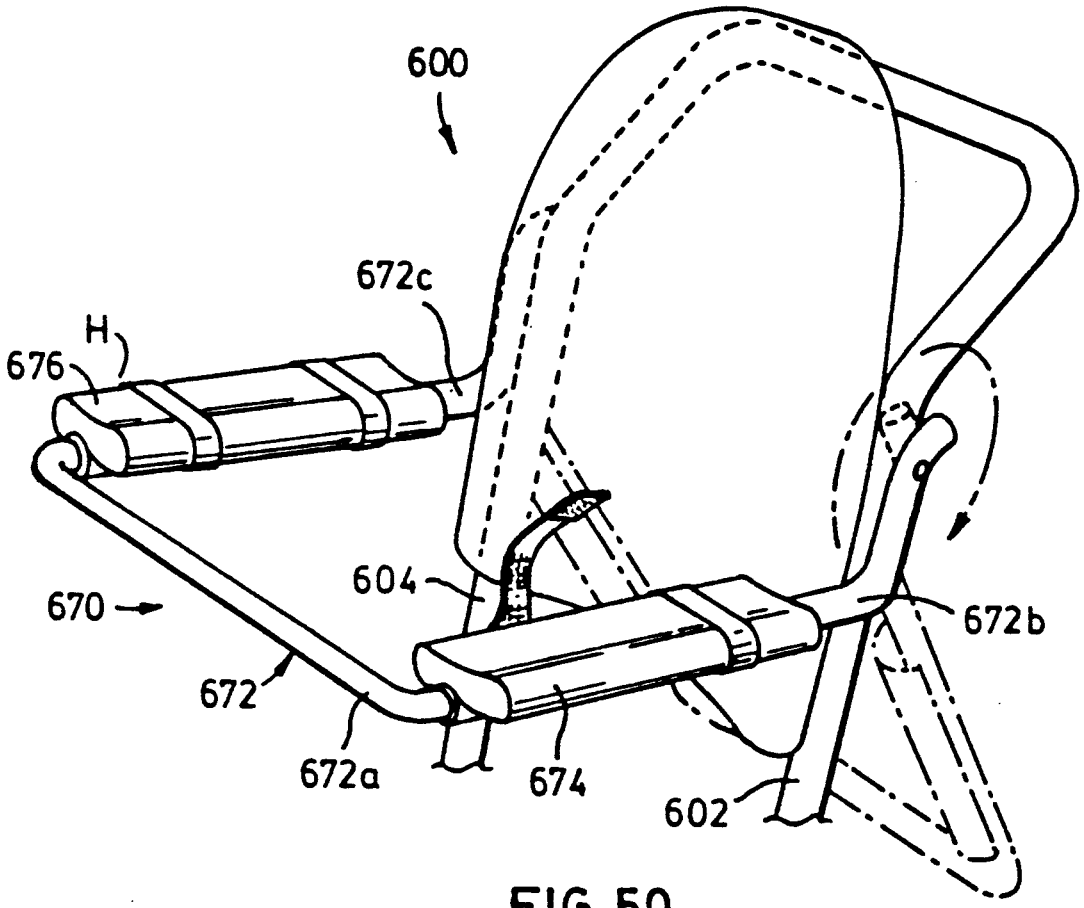
FIG. 50 is a fragmentary perspective view of still another mobility device.

Referring to FIG. 50, the chair 600 is provided with an arm assembly 670 formed from a U-shaped element 672 having a bight 672*a* and a pair of arms 672*b*, 672*c* extending from opposite ends thereof. The free ends of the arms are upturned and pivoted to the respective frame sections. The arm assembly 670 is movable from an operative position H to a storage position I wherein the user has improved access to the seat and back of the chair 600.

Arm pads 674,676 are further attached to the arms 672*a*,672*b* respectively. Each arm pad has a strap to retain the user's arms thereto, if desired.

Figure 49:
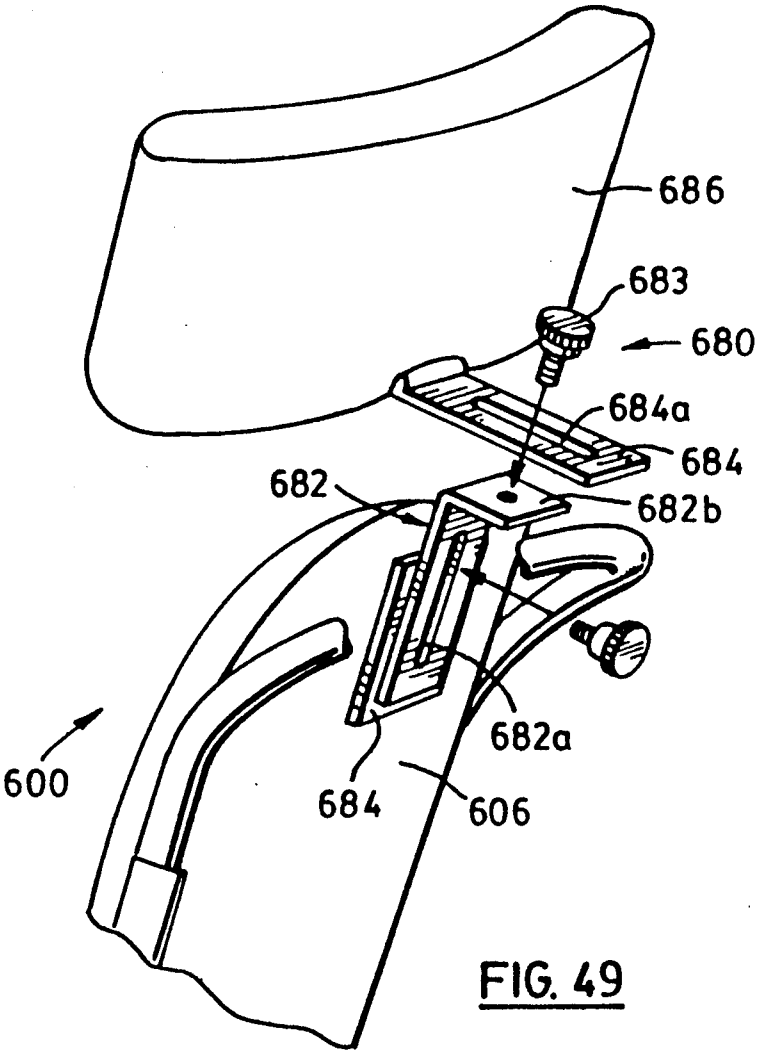
FIG. 49 is a fragmentary perspective view of another portion of the mobility device illustrated in FIG. 48.

In another embodiment in FIG. 49, the chair is provided with a headrest 680 which is mounted on the backrest 606 of the chair. The headrest has a first L-shaped arm 682 slidable vertically relative to a base plate 684, the latter of which is mounted to the back 606. The L-shaped arm has one portion provided with a slot 682*a* which receives a turn knob to lock the L-shaped arm in position against the base plate. The L-shaped arm has another portion 682*b* which has a hole threaded therein to receive a turn knob 683 which is located within a slot 684*a* formed in a second arm 684. One end of the second arm is mounted to the headrest 686.

This arrangement is not only simple to manufacture but it permits the headrest to move in a vertical plane, that is in the direction parallel to the baseplate 684, and in a horizontal plane, that is the direction parallel to the portion 682*b* while maintaining the orientation of the headrest relative to the chair throughout such movement.

We claim:

1. A mobile support device for a handicapped person and rollable along a reaction surface, the mobile support device comprising:

frame means including first and second longitudinally extending frame sections oriented in spaced relationship, each of said frame sections having a lower portion and a front portion;

a back support portion extending between and coupled with the first and second frame sections;

a seat portion extending between and coupled with the first and second frame sections and centrally disposed above said lower portions; and a wheel assembly mounted on said lower portions so as to engage the reaction surface, said wheel assembly including a pair of front caster wheels, a pair of rear caster wheels, and a pair of intermediate wheels, each of said intermediate wheels having a fixed transverse axis of rotation and being positioned intermediate said front and rear caster wheels to inhibit transverse motion, each of said frame sections carrying out of said front caster wheels, one of said intermediate wheels and one of said rear caster wheels, each of said wheels having a lower most tangent lying in a common plane, said spaced frame sections defining a free region in front of said seat portion through which said handicapped person's feet can reach said reaction surface and provide a propelling force to said mobile support device, said wheels being disposed outside of said free region, said lower portions being rigid to inhibit relative vertical displacement between said caster wheels and said intermediate wheels so that said wheel assembly constitutes means to inhibit rocking of said first and second frame sections about said intermediate wheels so that contact between all of said wheels with said reaction surface is maintained, the front portions of said frame sections being spaced from one another so that unrestricted access is provided for the handicapped person to said seat portion, said back support portion, and said free region.

2. A mobile support device as claimed in claim 1 further comprising a releasable restraint means disposed adjacent said seat portion and coupled to the first and second frame sections.

3. A mobile support device as claimed in claim 2 wherein said seat portion is pivotal relative to said first and second frame sections.

4. A mobile support device as claimed in claim 3 wherein said seat portion is pivotal between a first position and a second position in which said seat portion is in a forwardly downwardly inclined position.

5. A mobile support device as claimed in claim 4 wherein the first position is a rearwardly downwardly inclined position.

6. A mobile support device as claimed in claim 1 further comprising adjustment means to adjust the height of said seat portion relative to said frame sections.

7. A mobile support device as claimed in claim 6 wherein said seat portion includes a seat frame movable relative to said frame sections and said adjustment means includes a guide means engaged with said seat frame to guide said seat frame along a predetermined path relative to said frame sections.

8. A mobile support device as claimed in claim 7 wherein said seat frame includes a pivot element defining an axis of rotation of said seat portion and movable relative to said guide means.

9. A mobile support device as claimed in claim 2 wherein the upper region of said first and second frame sections define arm elements on each side of said seat portion.

10. A mobile support device as claimed in claim 9 wherein one of said arm elements is separable from the respective frame sections.

11. A mobile support device as claimed in claim 9 wherein one of said arm elements is pivotal relative to the respective frame section.

12. A mobile support device as claimed in claim 9 wherein said restraint means includes a tray element releasably joined to one of said arm elements.

13. A mobile support device as claimed in claim 12 wherein said tray element is contoured to define a hand grip.

14. A mobile support device as claimed in claim 12 wherein said tray element extends along one of said arm elements to define an arm rest.

15. A mobile support device as claimed in claim 1 further comprising braking means for providing releasable resistance to the rotation of said wheels.

16. A mobile support device as claimed in claim 15 wherein said braking means is arranged to brake said intermediate wheels, said braking means including a pair of brake pad means, each of which is engageable with a corresponding intermediate wheel and actuation means to cause said brake pad means to engage said intermediate wheels.

17. A mobile support device as claimed in claim 16 wherein said actuation means further includes a pair of levers, each of which is pivotally coupled to a corresponding frame section.

18. A mobile support device as claimed in claim 17 wherein said levers are fixed to a common pivot rod along said pivot axis.

19. A mobile support device as claimed in claim 1 wherein each of said first and second frame sections has an upper portion in spaced and substantially parallel and horizontal relationship with said lower portion and a central portion joining one end of the upper portion with an opposite end of the lower portion.

20. A mobile support device as claimed in claim 19 wherein said central portion is formed from first and second frame elements, the first frame element being joined to the rear end of the support frame portion and the second frame element being joined to the front end of the lower portion, the central frame elements being interconnectable at their ends in a telescoping manner.

21. A mobile support device as claimed in claim 1 further comprising a foot support means extending forwardly of and respectively pivotally coupled with one of said first and second frame sections.

22. A mobile support device as claimed in claim 21 wherein said foot support means has an extensible member and includes an adjustment mechanism to adjust the length of said extensible member.

23. A mobile support device as defined in claim 1 wherein each of said front caster wheels, said rear caster wheels and said of intermediate wheels is fixedly mounted to the corresponding lower portion to inhibit relative vertical displacement between said wheel and said lower portion.

24. An occupant propelled mobile support device for a handicapped person and rollable along a reaction surface, the mobile support device comprising:

frame means including first and second longitudinally extending frame sections oriented in spaced relationship, each of said frame sections having a lower portion and a front portion;

a back support portion extending between and coupled with the first and second frame sections;

a seat portion extending between and coupled with the first and second frame sections and centrally disposed above said lower portions; and a wheel assembly mounted on said lower portions so as to engage the reaction surface, said wheel assembly including a pair of front caster wheels, a pair of rear caster wheels, and a pair of intermediate wheels, each of said intermediate wheels having a fixed transverse axis of rotation and being positioned intermediate said front and rear caster wheels to inhibit transverse motion, each of said frame sections carrying one of said front caster wheels, one of said intermediate wheels and one of said rear caster wheels, each of said wheels having a lower most tangent lying in a common plane, said spaced frame sections defining a free region in front of said seat portion through which said handicapped person's feet can reach said reaction surface and provide a propelling force to said mobile support device, said wheels being disposed outside of said free region, said lower portions being rigid to inhibit relative vertical displacement between said caster wheels and said fixed axle wheels so that said wheel assembly constitutes means to inhibit rocking of said first and second frame sections about said intermediate wheels so that contact between all of said wheels with said reaction surface is maintained, the front portions of said frame sections being spaced from one another so that unrestricted access is provided for the handicapped person to said seat portion, said back support portion, and said free region, said device further comprising a braking means for braking at least one wheel on each of said frame sections.

* * * * *